US009883305B2

(12) United States Patent
Risberg et al.

(10) Patent No.: US 9,883,305 B2
(45) Date of Patent: Jan. 30, 2018

(54) NON-LINEAR CONTROL OF LOUDSPEAKERS

(71) Applicant: Cirrus Logic International Semiconductor Ltd., Edinburgh (GB)

(72) Inventors: Par Gunnars Risberg, Stockholm (SE); Ylva Bjork, Solna (SE); Ebba Wilhelmsson, Gothenburg (SE); Landy Toth, Doylestown, PA (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/125,877

(22) PCT Filed: Mar. 19, 2015

(86) PCT No.: PCT/US2015/021422
§ 371 (c)(1),
(2) Date: Sep. 13, 2016

(87) PCT Pub. No.: WO2015/143127
PCT Pub. Date: Sep. 24, 2015

(65) Prior Publication Data

US 2017/0006394 A1 Jan. 5, 2017

Related U.S. Application Data

(60) Provisional application No. 61/955,426, filed on Mar. 19, 2014.

(51) Int. Cl.
*H04R 3/04* (2006.01)
*H04R 29/00* (2006.01)
*H04R 3/00* (2006.01)

(52) U.S. Cl.
CPC ..... *H04R 29/003* (2013.01); *H04R 3/002* (2013.01); *H04R 3/007* (2013.01); *H04R 3/04* (2013.01); *H04R 29/001* (2013.01)

(58) Field of Classification Search
CPC ..... H04R 3/002; H04R 3/007; H04R 29/003; H04R 29/001; H04R 3/04
(Continued)

(56) References Cited

U.S. PATENT DOCUMENTS

2005/0031139 A1 2/2005 Browning et al.
2007/0160221 A1* 7/2007 Pfaffinger ..... H04R 29/001 381/59
(Continued)

FOREIGN PATENT DOCUMENTS

EP 2369852 A1 9/2011
WO 2013/182901 A1 12/2013
WO WO 2013182901 A1 * 12/2013 ..... H04R 3/002

OTHER PUBLICATIONS

Klippel, "Active Compensation of Transducer Nonlinearities", AES 23rd International Conference, 2003, pp. 1-17.
(Continued)

*Primary Examiner* — Melur Ramakrishnaiah
(74) *Attorney, Agent, or Firm* — Jackson Walker L.L.P.

(57) ABSTRACT

A nonlinear control system includes a controller, a model updater, and a model. The controller is configured to accept one or more input signals, and one or more updates generated by the model updater to produce one or more control signals. The system is configured to drive one or more transducers with the control signals to produce a rendered audio stream therefrom. The model updater is configured to analysis one or more portions of the audio stream and to update one or more aspects of the controller so as to alter performance of the transducer.

29 Claims, 3 Drawing Sheets

(58) Field of Classification Search
USPC ..... 381/59, 28, 60, 63–64
See application file for complete search history.

(56) References Cited

U.S. PATENT DOCUMENTS

| | | | | |
|---|---|---|---|---|
| 2010/0111350 | A1* | 5/2010 | Eaton | H04M 1/03 381/386 |
| 2011/0228945 | A1* | 9/2011 | Mihelich | H04R 3/002 381/59 |
| 2012/0121098 | A1* | 5/2012 | Gautama | H04R 3/007 381/59 |
| 2015/0304772 | A1* | 10/2015 | Risberg | H04R 3/002 381/55 |

OTHER PUBLICATIONS

The International Search Report and the Written Opinion issued by EPO dated Jun. 24, 2015 for International application No. PCT/US2015/021422.

* cited by examiner

NON-LINEAR CONTROL OF LOUDSPEAKERS

REFERENCE TO PREVIOUSLY FILED APPLICATIONS

The present application is a 35 U.S.C. 371(c) National Stage Application of International Application No. PCT/US2015/021422, filed on Mar. 19, 2015, which in turn claims priority under 35 U.S.C. § 119(a) to U.S. Provisional Application No. 61/955,426, filed on Mar. 19, 2014, each of which are incorporated herein by reference in its entirety.

BACKGROUND

Technical Field

The present disclosure is directed to digital control of loudspeakers and particularly to nonlinear digital control systems for implementation in audio signal processing.

Background

Mobile technologies and consumer electronic devices (CED) continue to expand in use and scope throughout the world. In parallel with continued proliferation, there is rapid technical advance of device hardware and components, leading to increased computing capability and incorporation of new peripherals onboard a device along with reductions in device size, power consumption, etc. Most devices, such as mobile phones, tablets, and laptops, include audio communication systems and particularly one or more loudspeakers to interact with and/or stream audio data to a user.

Every device has an acoustic signature, meaning the audible characteristics of a device dictated by its makeup and design that influence the sound generated by the device or the way it interacts with sound. The acoustic signature may include a range of nonlinear aspects, which potentially depend on the design of the device, on the age of the device, and/or the environment in which the device operates. The acoustic signature of the device may significantly influence the audio experience of a user.

Audio experience is one of many factors considered in the design of consumer electronic devices. Often, the quality of audio systems, loudspeakers, etc. are compromised in favor of other design factors such as cost, visual appeal, form factor, screen real-estate, case material selection, hardware layout, and assembly considerations amongst others.

Many of these competing factors are favored at the expense of the audio quality, as determined by the audio drivers, component layout, loudspeakers, material and assembly considerations, housing design, etc. In addition, due to the reduced available real estate and miniaturized component size, nonlinearities in the acoustic characteristics of such devices are becoming particularly relevant as the loudspeakers in such devices are being pushed to the limits of their capabilities.

Improved acoustic performance may be achieved, generally with additional cost, increased computational complexity, and/or increased component size. Such aspects are in conflict with the current design trend. As such, cost, computation, and size sensitive approaches to addressing nonlinear acoustic signatures of devices would be a welcome addition to a designer's toolbox.

SUMMARY

One objective of this disclosure is to provide a nonlinear control system for a loudspeaker.

Another objective is to provide a nonlinear control system suitable for implementation across a family of mass manufactured loudspeakers.

Another objective is to provide a robust nonlinear control system for a loudspeaker.

Yet another objective is to provide a manufacturing method for configuring a nonlinear control system in accordance with the present disclosure for an associated consumer electronics device.

The above objectives are wholly or partially met by devices, systems, and methods according to the appended claims in accordance with the present disclosure. Features and aspects are set forth in the appended claims, in the following description, and in the annexed drawings in accordance with the present disclosure.

According to a first aspect there is provided, a nonlinear control system for rendering a media stream through a transducer including, a controller including a feed forward model, the model configured to accept an input signal relating to the media stream and to output a control signal to drive an amplifier and/or the transducer for rendering the media stream thereupon, the model configured to compensate for one or more acoustic characteristics of the transducer, the amplifier, and/or an environmental parameter, one or more sensors coupled with the transducer, the amplifier, and/or the environment configured to generate a feedback signal therefrom, and a model updating function coupled with the controller, configured to accept a dataset derived from the feedback signal, the input signal, the control signal, and/or a signal generated therefrom, and to update one or more aspects of the model based upon an analysis of the dataset.

In aspects, one or more of the sensors may be configured to measure or generate a signal related to a current, voltage, an impedance, a conductance, a substantially DC impedance value, a resonant property, a temperature, a voice coil current, a voice coil temperature, a membrane or coil displacement, a velocity, an acceleration, an air flow, a chamber back pressure, a transducer vent airflow, a sound pressure level, a kinetic measurement, a magnetic field measurement, a pressure, a humidity, a combination thereof, or the like.

In aspects, the controller may be configured to operate at a rendering rate and the model updating function may be configured to periodically update the model at an updating rate, the updating rate substantially slower than the rending rate. In aspects, the updating rate may be less than 1 update per second, less than 0.1 updates per second, less than 1 update per minute, less than 1 update per hour, or the like.

In aspects, a system in accordance with the present disclosure may include a scheduler configured to determine the updating rate through analysis of the dataset. Some non-limiting examples of such analysis may include analyzing one or more metrics associated with the dataset to determine a subset thereof that is suitable for performing an update therefrom. In aspects, one or more of the metrics may be associated with amplitude, bandwidth, relationships between, combinations thereof, or the like related to one or more of an input signal, control signal, rendered media stream, and/or feedback signal.

In aspects, the system may include a buffer coupled with the model updater configured to store at least a portion of the dataset.

In aspects, the model updating function may include or interface with a robust regression algorithm, a model bank, and/or a selection algorithm to perform at least a portion of the analysis. In aspects, the model updating function may include and/or interface with a bank of models, each model in the bank configured to generate an estimate of a state from the dataset, the model updating function configured to compare the state against one or more aspects of the dataset as part of the analysis. In aspects, the model update function may include or interface with a selection algorithm, the selection algorithm configured to select a model from the model bank or a model related to a model in the model bank based upon the comparison.

In aspects, the system may be configured to accept a notification, the notification integrated into the media stream, at least a portion of the dataset derived from the media stream rendered during the notification. Some non-limiting examples of a notification include a media clip relating to a ring tone, a wakeup notification, a game sound clip, a media introduction, a video clip, movie or TV show clip, a song clip, an event, a power-up event, a user notification, a sleep recovery event, a touch audio response, a combination thereof, or the like associated with the rendering stream.

In aspects, the model update algorithm may include a change detection algorithm configured to analyze the dataset to determine if a substantial difference exists between the model in the controller and one or more acoustic characteristics of the transducer. The change detection algorithm may be used to determine at least a portion of the updating rate, for a diagnostic purpose, to assess the performance of a controller model, or the like.

In aspects, a model in a controller in accordance with the present disclosure may include a linear dynamic model and a nonlinear model. In aspects, the model updating function may be configured to update a portion of the linear dynamic model or the nonlinear model based upon the analysis of the dataset.

In aspects, a system in accordance with the present disclosure may be included within a mobile consumer electronic device in accordance with the present disclosure. Some non-limiting examples of a consumer electronics device may include a cellular phone (e.g., a smartphone), a tablet computer, a laptop computer, a portable media player, a television, a portable gaming device, a gaming console, a gaming controller, a remote control, an appliance (e.g., a toaster, a refrigerator, a bread maker, a microwave, a vacuum cleaner, etc.) a power tool (a drill, a blender, etc.), a robot (e.g., an autonomous cleaning robot, a care giving robot, etc.), a toy (e.g., a doll, a figurine, a construction set, a tractor, etc.), a greeting card, a home entertainment system, an active loudspeaker, a media accessory (e.g., a phone or tablet audio and/or video accessory), a wearable device, a sound bar, and the like.

In aspects, a transducer in accordance with the present disclosure may be designed so as to include a deficient acoustic characteristic of sufficient severity so as to corrupt rendering of the input signal without compensation, the model in the controller configured to compensate for the deficient acoustic characteristic so as to effectively render the media stream on the transducer without substantial corruption. Such a configuration may be beneficial for realizing non-traditional transducer designs, transducer designs that are impossible to drive when not coupled with a controller in accordance with the present disclosure, more efficient yet more nonlinear transducers, or the like. In one non-limiting example, the transducer may be a speaker, and the deficient acoustic characteristic may be, or be related to a nonlinearity and/or instability of a force factor, stiffness, mechanical resistance, port noise, or the like associated with the speaker. In aspects, the uncompensated deficient acoustic characteristic may contribute to more than 10%, more than 25%, or more than 35% of an acoustic output from the transducer, the model in the controller configured to reduce this contribution to less than 10%, less than 5%, or less than 2%. In aspects, the model updating function may be configured to update the model in the controller whenever the compensated deficient acoustic characteristic contributes more than 5%, more than 15%, more than 25% above a residual threshold thereof. In aspects, assessment of the deficient acoustic characteristic may be manifested on, or extracted from one or more of a feedback signal in accordance with the present disclosure.

In aspects, the transducer may be designed to have a relatively high efficiency while sacrificing sound quality, THD, and/or IMD in an uncompensated state of operation, the controller configured to substantially improve the sound quality, THD and/or IMD while maintaining the relatively high efficiency thereof during a compensated state of operation.

In aspects, an amplifier, a scheduler, and/or a model updater in accordance with the present disclosure may include a means for estimating a characteristic temperature of the transducer from one or more of the feedback signals, and delivering the estimate to one or more of the controller and/or the model updater, the controller and/or the model updater configured to incorporate the temperature estimate into the compensation and/or analysis algorithms respectively.

According to aspects there is provided, use of a system in accordance with the present disclosure to improve the efficiency of a transducer family without substantially compromising sound quality.

According to aspects there is provided, use of a system in accordance with the present disclosure, to reduce THD and/or IMD in a rendered media stream.

According to aspects A method for updating a model for use in rendering an audio stream on a transducer including, collecting data associated with the audio stream over one or more time periods to form a dataset, analyzing the dataset to determine if the content has amplitude and spectral content above a predetermined threshold sufficient to perform the update, generating an updated model or portion thereof using at least a portion of the dataset, and updating the model with the updated model or portion thereof.

In aspects, a method in accordance with the present disclosure may include comparing output of a plurality of predetermined models against at least a portion of the dataset, and selecting a model associated with one of the plurality of predetermined models to be the updated model, wherein the comparison may be based upon analysis of a metric comparing closeness of fit between the predetermined models and the portion of the dataset. Some non-limiting examples of a metric for comparison include a robust residual, a cumulative sum of error, a maximum likelihood assessment, a likelihood ratio test, a square residual threshold test, an amplitude comparison between input and output across frequency bands of interest, a combination thereof, or the like between one or more estimates generated by the predetermined models and the dataset.

In aspects, one or more of the time periods may be longer than 0.1 s, longer than 0.25 s, longer than 0.5 s, longer than 1 s, or the like.

According to aspects there is provided, a method for updating a model of a transducer including, applying a test signal to the transducer during a user notification event and collecting data associated therewith to form a dataset, analyzing the dataset to form an update structure comprising one or more of an updated model, a model characteristic, a model parameter, a linear portion of a model, a nonlinear function in a model, a pointer to a nearest fit model, a combination thereof, or the like, and updating the model with the update structure. Some non-limiting examples of a user notification event include rendering on the transducer one or more of a media clip relating to a ring tone, a wakeup notification, a game sound clip, a media introduction, a video, movie or TV show clip, a song clip, an event, a power-up, a user notification, a sleep recovery event, a touch audio response, a combination thereof, or the like. In aspects, the user notification event may span a time period of longer than 0.1 s, longer than 0.25 s, longer than 0.5 s, or longer than 1 s.

In aspects, the method may include forming the dataset from a sequential application of a plurality of test signals, and/or comparing the dataset with a predetermined expected outcome for the notification event to determine if the dataset is suitable for performing the update.

In aspects, the model updating function may include a nonlinear observer, a sliding mode observer, a Kalman filter, an adaptive filter, a least means square adaptive filter, an augmented recursive least square filter, an extended Kalman filter, ensemble Kalman filter, high order extended Kalman filters, a dynamic Bayesian network. In aspects, the observer may include an unscented Kalman filter or an augmented unscented Kalman filter to generate one or more of the estimated states for comparison with an input, control signal, feedback signal, a combination thereof, or the like.

In aspects, the controller may include a protection block, the protection block configured to analyze one or more of the input signals, and/or the control signals and to modify the control signals based upon the analysis.

In aspects, the amplifier may be configured to interconnect the control signal with the transducer. The amplifier may be configured to monitor one or more of a current signal, a voltage signal, a power signal, and/or a transducer impedance signal and to provide the signal as feedback to one or more component of the nonlinear control system.

The controller or a model included therein may include one or more parametrically defined parameters, the function of the controller dependent on the parameters and the model updating function may be configured to adjust one or more of the parameters to reduce a distortion aspect in an associated media stream rendered thereupon.

Some non-limiting examples of transducers include an electromagnetic loudspeaker, a piezoelectric actuator, an electroactive polymer based loudspeaker, an electrostatic loudspeaker, combinations thereof, or the like.

DETAILED DESCRIPTION

Figure 1:
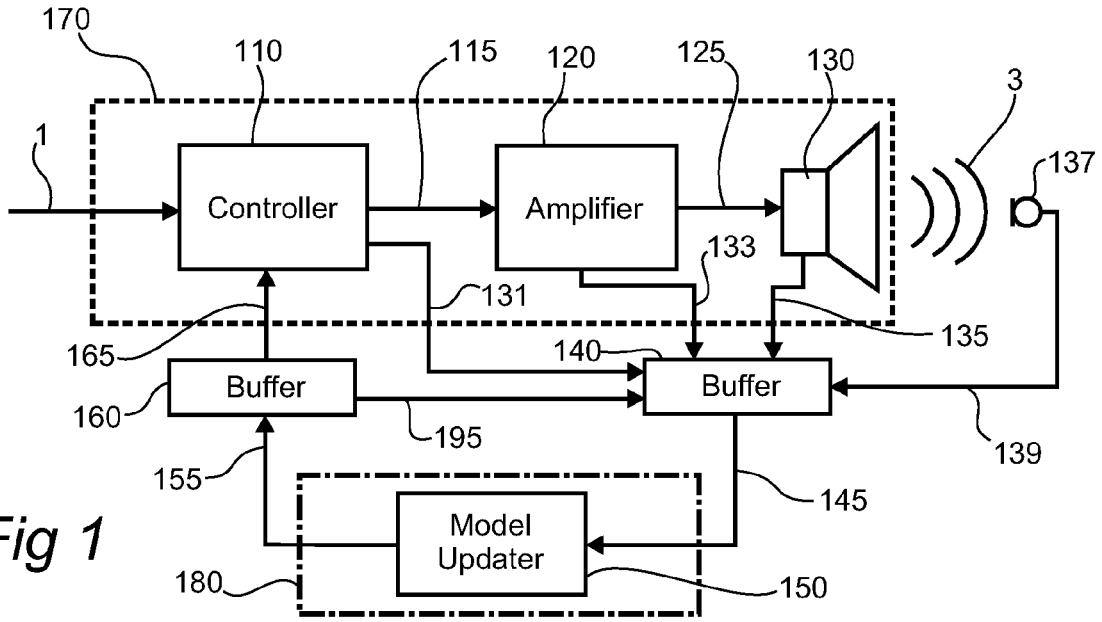
FIG. 1 shows a schematic diagram of aspects of a nonlinear control system in accordance with the present disclosure.

Particular embodiments of the present disclosure are described herein below with reference to the accompanying drawings; however, the disclosed embodiments are merely examples of the disclosure and may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in virtually any appropriately detailed structure. Like reference numerals may refer to similar or identical elements throughout the description of the figures.

By consumer electronic device is meant a cellular phone (e.g., a smartphone), a tablet computer, a laptop computer, a portable media player, a television, a portable gaming device, a wearable computing device, a gaming console, a gaming controller, a remote control, an appliance (e.g., a toaster, a refrigerator, a bread maker, a microwave, a vacuum cleaner, etc.) a power tool (a drill, a blender, etc.), a robot (e.g., an autonomous cleaning robot, a care giving robot, etc.), a toy (e.g., a doll, a figurine, a construction set, a tractor, etc.), a greeting card, a home entertainment system, an active loudspeaker, a media accessory (e.g., a phone or tablet audio and/or video accessory), a sound bar, etc.

By input audio signal is meant one or more signals (e.g., a digital signal, one or more analog signals, a 5.1 surround sound signal, an audio playback stream, etc.) provided by an external audio source (e.g., a processor, an audio streaming device, an audio feedback device, a wireless transceiver, an ADC, an audio decoder circuit, a DSP, etc.).

By acoustic signature is meant the audible or measurable sound characteristics of a consumer electronic device and/or a component thereof (e.g., a loudspeaker assembly, with enclosure, waveguide, etc.) dictated by its design that influence the sound generated by the consumer electronic device and/or a component thereof. The acoustic signature may be influenced by many factors including the loudspeaker design (speaker size, internal speaker elements, material selection, placement, mounting, covers, etc.), device form factor, internal component placement, screen real-estate and material makeup, case material selection, hardware layout, and assembly considerations amongst others. Cost reduction, form factor constraints, visual appeal, and many other competing factors are often favored during the design process at the expense of the audio quality of the consumer electronic device. Thus the acoustic signature of the device may deviate significantly from an ideal response. In addition, manufacturing variations in the above factors may significantly influence the acoustic signature of each device, causing further part to part variations that degrade the audio experience for a user. Some non-limiting examples of factors that may affect the acoustic signature of a consumer electronic device include: insufficient speaker size, which may limit movement of air necessary to re-create low frequency sound, insufficient space for the acoustic enclosure behind the membrane which may lead to a higher natural roll-off frequency in the low end of the audio spectrum, insufficient amplifier power available, an indirect audio path between membrane and listener due to speaker placement often being on the back of a TV or under a laptop, relying on reflection to reach the listener, among others factors.

In aspects, a system in accordance with the present disclosure may be used to help reduce or relax one or more design constraints on one or more components of an associated loudspeaker (e.g., reduce "as designed" linearity to boost other speaker properties, reduce fabrication cost, eliminate components, reduce component complexity, reducing a back cavity volume, etc.) or product (e.g., relax housing leakage tolerances, relax flexural tolerance of housing walls, relaxing a volumetric tolerance on a cavity, etc.). In such scenarios, a nonlinear controller in accordance with the present disclosure may be adapted to overcome a deficiency introduced by or to compensate for the relaxed constraint, thus providing adequate or even high quality performance while reducing the size, complexity, cost, and/or power requirements needed to operate the device.

Some non-limiting examples of such usage include relaxing an "as designed" specification, such as sound output linearity, flatness of output, acoustic quality at resonance, etc. and/or simplification, mass reduction of, reduction in manufacturing tolerance of, or removal of one or more components of the loudspeaker.

In one non-limiting example, a loudspeaker for use in combination with a system in accordance with the present disclosure may include a voice coil, and a magnet, the magnet arranged so as to provide a magnetic field over a length through which the voice coil may pass. In a traditional speaker design, the length and movement of the voice coil may be configured such that it matches the length of the magnetic field. Such a configuration may be provided to improve linearity over range of inputs provided to the speaker during use. Alternatively, a dramatic reduction in the length of the voice coil and/or an increase in the length of travel of the voice coil versus the length of the magnetic field, may be provided, to increase efficiency, and/or reduce the profile of the speaker (often at the expense of audio output quality thereof). A control system in accordance with the present disclosure may be coupled with the loudspeaker and configured to overcome reduced linearity with such a configuration. Thus a system in accordance with the present disclosure may be used to boost or maintain the quality of speaker output while providing a lower cost, lower profile, and/or more efficient overall speaker design.

An acoustic signature may include one or more nonlinear aspects relating to material selection, design aspects, assembly aspects, etc. that may influence the audio output from the associated device, causing such effects as intermodulation, harmonic generation, sub-harmonic generation, compression, signal distortion, bifurcation (e.g., unstable states), chaotic behavior, air convective aspects, and the like. Some non-limiting examples of nonlinear aspects include eddy currents, cone positional nonlinearities, coil/field nonlinearities, DC coil displacement, electromechanical nonlinearities (e.g., magnetic and/or E-field hysteresis), viscoelastic and associated mechanical aspects (e.g., suspension nonlinearities, nonlinear damping, in the spider, mounting frame, cone, suspension geometry, etc.), assembly eccentricities, driver characteristics, thermal characteristics, acoustic radiation properties (e.g., radiation, diffraction, propagation, room effects, convection aspects, etc.), audio perception characteristics (e.g., psychoacoustic aspects), and the like.

Such nonlinear aspects may be amplitude dependent (e.g., thermally dependent, cone excursion dependent, input power dependent, etc.), age dependent (e.g., changing over time based on storage and/or operating conditions), operating environment dependent (e.g., based on slow onset thermal influences), aging of mechanical and/or magnetic dependent (e.g., depolarization of associated magnetic materials, aging of rubber and/or polymeric mounts, changes associated with dust collection, etc.), dependent upon part-to-part variance (e.g., associated with manufacturing in precision, positioning variance during assembly, varied mounting pressure, etc.), and the like.

A nonlinear control system in accordance with the present disclosure may be configured to compensate for one or more of the above aspects, preferably during playback of a general audio stream (e.g., an impromptu audio stream). Such nonlinear control systems may be advantageous to effectively extend the audio quality associated with an audio stream to the limits of what the associated hardware can handle.

In aspects, one or more components of a control system in accordance with the present disclosure may include or interface with a scheduler or equivalent scheduling function. The scheduler may be configured to initiate a time scheduled analysis, a feedback initiated analysis, an update initiated analysis, a seamlessly integrated analysis (see below), combinations thereof, or the like. Such initiation of analysis may be determined by assessment of one or more streams of input/output data, or the like. The outcome of such assessment may be used to initiate an adaptation function within the control system (e.g., for adapting one or more aspects of the control system to better match the properties of the loudspeaker or related components at any given time). Such a configuration may be advantageous for implementing the adaptation process on a non-real time operating system, for offline adaption of one or more speaker parameters, for performing adaptation with limited resources, and/or under power constraints, such as commonly coincide with mobile applications and devices.

By time scheduled analysis is meant a period of time within which an updated analysis may be performed, the period of time based upon expected rate of change in the properties of the loudspeaker during use. Such a period of time may be configured during the design of the system, may be dependent upon operating conditions (e.g., power usage, operating conditions such as temperature, humidity, etc., dependent on the type of audio streamed through the device, or the like).

By feedback initiated analysis is meant an algorithm comparing one or more feedback parameters from the loudspeaker or an associated component (such as current feedback, impedance, loudspeaker parameter measurement, resonant frequency, etc.) against one or more aspects of the controller (such as a corresponding current estimate, impedance estimate, loudspeaker parameter estimate, resonant frequency estimate, etc.) to determine if a mismatch between the parameters and estimates are significant. If significant, the scheduler may initiate an adaption process in order to correct for the mismatch, initiate a diagnostic test, etc.

By update initiated analysis is meant an analysis that is performed as part of an update process. Such an analysis may be hidden within an audio stream inserted as part of the update process (e.g., as part of a firmware update, an app update, an app purchase, a network connection/disconnection, a notification, a reboot, etc.). In aspects, the scheduler may initiate an adaption process when one of the update processes naturally occurs as part of the device function. Such a process may be combined with a user notification (e.g., an audible sequence to alert a user, etc. as part of the update process). By combining the analysis with the update process, the necessary data to perform a large signal adaption of the controller may be performed without interfering with daily user/device interaction.

By a seamlessly integrated analysis is meant an analysis whereby the necessary data for performing an adaption process is collected either over time, or as opportunity present during use of the device (e.g., during a user notification, a reboot, a wake-up event, a dial tone, a ring tone, etc.). In aspects, such analysis may include collecting audio stream snippets as available from the overall device audio stream, the snippets formable into a complete dataset for use in the adaption algorithm. In aspects, as data for the adaption may be collected in preparation for an adaption, the scheduler may initiate the adaptation process when the collected data is sufficient to perform the adaptation (e.g., when sufficient amplitude and frequency specific data points are available from the collected data to perform an adaption). In aspects, the scheduler may be configured to prioritize data collection, or initiate adaptation as needed or prescribed for the associated loudspeaker and connected audio system. Such assessment may be configured to collect as available from the device without significantly impacting user experience.

Such approaches to collecting the necessary data may be advantageous for ensuring the adaptation algorithm may proceed to a solution in a reduced timeframe, may improve the probability that the adaptation process is successful, may improve the probability that the adaptation process converges to the ideal or matching system model, etc.

One or more scheduling processes, or data collection processes for performing an adaption procedure may be combined with a user notification (e.g., an audible sequence to alert a user, etc. as part of the update process). By combining the analysis with the update process, the necessary data to perform a large signal adaption of the controller may be performed without interfering with daily user/device interaction.

In aspects, the control system may be configured to operate at two or more rates, a high rate and one or more lower rates. The high rate may be configured to manage real-time or near real-time rendering of data on the device (e.g., a loudspeaker). Such a high rate may be suitable for a wide range of audio rendering applications. In aspects, such a high rate may be configured to be greater than 22 kHz, greater than 44 kHz, greater than 192 kHz, or the like.

In aspects, in addition to the high rate, one or more aspects of the control system and/or associate scheduler may be configured to operate at one or more lower rates. Such lower rates may be related to one or more adaptation, audio tests, diagnostic tests, etc. Such rates may be fixed or variable such as described herein. In aspects, the period associated with such rates may be on the order of 5 s, on the order of 1 min, or the like.

In aspects, a model updater or scheduler in accordance with the present disclosure may include one or more processes running at an intermediate rate. In aspects, the intermediate rate may be used to initiate an adaptation to accommodate for a change in operating conditions or environment that may happen on an intermediate timescale (e.g., on the order of 0.5 sec, on the order of 5 sec, etc.). Such an adaptation process may be used to update one or more aspects of an associated controller model to compensate for changes in an operating condition, such as a change in voice coil temperature (e.g., as measured by current and/or voltage feedback from the associated loudspeaker), a change in ambient humidity, pressure, a change in loudspeaker acoustic impedance (e.g., such as measured when a speaker port is plugged, covered by a user, etc.), a combination thereof, or the like. Such changes may be performed over a relatively quick timeframe compared the timeframe associated with aging, or changes in nonlinear speaker parameters.

In aspects, the controller may include a plurality processes each associated with one or more rates: high, intermediate, low, etc. Each rate dependent process may be configured to relate to a particular function, such as rendering (high rate processes), updating operating condition dependent models (intermediate rate processes), updating nonlinear or large signal dependent models (low rate processes). Such processes may be run in parallel during regular operation of the system.

In aspects, a system may include a controller, the controller including a model, the controller configured to render an audio stream with the model at a substantially high rate, the model including linear and nonlinear aspects. The system may include a first model updater configured to update one or more linear parameters of the model at an intermediate rate (e.g., such as dictated by changes in operating conditions, environmental changes, changes in the audio stream, etc.). The first model updater may be associated with a data collection block configured to capture small signal data from the audio stream and perform the necessary updates therewith at a somewhat intermediate rate (e.g., as conditions dictate). The system may include a second model updater configured to update one or more nonlinear or large signal parameters of the model at a substantially slower rate (e.g., as dictated by collection or availability of data during rendering of the audio stream). The second model updater may include a data collection subsystem configured to collect snippets of suitable data over time, optionally validate the collected data, and optionally stitch the data together to form an actionable data set (e.g., a data set that is suitable for performing a large signal model update). Such a data collection subsystem may be suitable for collecting and validating data for use in an adaptation process without demanding substantial system resources. Such a configuration may be advantageous for robustly adaptively updating a nonlinear controller while minimizing computational effort (e.g., as opposed to continual implementation of a recursively implemented adaptive update, etc.).

In aspects a model updater or scheduler in accordance with the present disclosure may include one or more functions configured to assess the collected data prior to performing an adaption on one or more aspects of the associated controller. The assessment may be performed to determine the validity of the collected data, to assess the completeness of the data in terms of covering the usage limits of the associated loudspeaker, to ensure that outliers in the data are removed prior to performing an adaption algorithm therewith, etc.

In aspects, the model updater may include one or more functions configured to assess if the adaptation process has converged sufficiently, to assess if one or more model parameters have converged, etc. Such a function may be advantageous for evaluating when to complete a periodically performed adaptive update on one or more aspects of the controller model.

In aspects, a model updater in accordance with the present disclosure may be configured to run a batch processed adaption of one or more associated models included in an associated controller, to perform validation or affirmation of the adaption process, and/or to update the model with coefficients, data, or parameters attained from the adaptation process. Initiation of such a process may be coupled with a scheduler or equivalent timing function. In aspects, the adaptation process may include one or more functions configured to perform a regression so as to match a model output with a measured signal (or a signal derived therefrom), perform a model selection, assess convergence of a model parameter to a measured parameter (or a parameter estimated from a measurement), or the like.

In aspects, the model updater may be configured to perform regression on one or more model parameters over the data set in order to match an output signal therefrom against a measured parameter. The model updater may be configured to recursively run the regression over and over again until convergence is achieved (e.g., with new data, the same data set, etc.). In aspects, the model updater may be configured to assess the convergence rate during the regression or a recursive process to determine if a solution will be or has been achieved.

In aspects, the model updater or associated buffer may be able to store previously converged models, the model updater including a function to compare one or more aspects of the present model against a stored model to assess progress with the adaptation, to select an appropriate model for use in the controller, etc.

In aspects, the model updater may compare one or more measured signals, or parameters or signals generated therefrom against a corresponding parameter, or aspect of a model stored in an associated model bank (e.g., as stored in a bank of known stable models for a manufactured family of loudspeakers, etc.). In aspects, the model bank may include a range of expected models or portions thereof for the associated loudspeaker, such models being generated during design, manufacturing, and/or during use of related loudspeakers in the field. The model bank may include a plurality of models configured to span the expected parameter space for the associated loudspeaker. The model bank may include one or more damage models, the damage models configured so as to represent the associated loudspeaker in a known failure mode (e.g., such as with a damaged voice coil, a damaged suspension, a dust accumulated model, a leakage model, etc.). Such damage models may be used during an adaptation process to assess if the associated controller model is within a known operating space, if the model is trending to a damage state or failure mode for the loudspeaker (e.g., a diagnostic function), etc. Comparison of an updated or measured feature against such damage models may be suitable for diagnosing a problem with the loudspeaker in the field. In aspects, the system may be configured to provide an alert, or issue a repair bill, etc. in the event that a damage model is confirmed to best fit the associated loudspeaker feedback.

In aspects, the model bank may include a plurality of bank models, each bank model associated with a corresponding parameter estimating model (e.g., for estimating one or more system parameters associated with the bank model). In aspects, the model updater may run one or more of the parameter estimating models against the collected data, and compare the output thereof against that of the measured signal, the adapted model parameter estimation, etc. The comparison may be used to select one or more bank models from the model bank that most closely fit the system, or the adaptive model. Such a comparison may be advantageous for adapting one or more aspects of the controller to an appropriate model without requiring significant computational resources.

In aspects, the model updater may include a function configured to compare one or more parameters from one or more models in the model bank against a measured signal, controller parameter, or parameter from the system, and selecting a model from the model bank to use within the controller, and/or confirming the adaptation process has produced a model within an acceptable range, etc.

In aspects, the model updater may be configured to operate with limited state feedback from the loudspeaker or components coupled thereto. The model updater may be configured to compare bank models, stored parameters, etc. against the adapted model to assist with the validation or convergence thereof prior to updating the controller with the adapted model. Such a configuration may be advantageous for implementation of a robust adaptive nonlinear control of loudspeakers with limited state feedback.

In aspects, one or more data collection blocks (e.g., buffers) may be included in the system. In aspects, the data collection blocks may be implemented as FIFOs buffers, such as may be filled with a steady stream of data, partial data, bursts of data, or the like. In aspects, the buffers may be filled when the inputs/outputs are in certain ranges (e.g., so as to cherry pick data to use in the adaptive algorithm, etc.). In aspects, the system may include a data collection algorithm configured to govern the buffer filling process. Such a data collection algorithm may be configured to remove outlying data points from the collected data, to collect data during periods with known audio streams (e.g., during notifications), to collect spread spectrum or spread amplitude data, to minimize collection of repetitive data, perform combinations thereof, or the like. Such selective data collection algorithms may be implemented so as to improve adaptation convergence, minimize waste of resources on trying to adapt the system model with repetitive data, with limited data, against outliers, etc.

In aspects, the data collection algorithm may selectively fill the buffer as descried herein. Once the buffer is filled, the scheduler may initiate a model update process in accordance with the present disclosure.

In aspects, the data collection algorithm may be configured to selectively monitor data entering the buffer to ensure that a minimum amount of actionable data is acquired for the adaptation process. Such a data collection algorithm may include a function for assessing the quality of data over a period of time, for determining if the data collected contains significant content in a bandwidth of interest, to determine if the data contains significant content within amplitude of interest, etc. In aspects, such a data collection algorithm may include a function to determine if a continuous block of data of a minimum length has been extracted from the audio stream which is suitable for performing the adaptation process (e.g., suitable in terms of bandwidth, amplitude, lack of outliers, noise profile, etc.).

In aspects, the model updater or data collection algorithm may be configured to piecewise construct a complete data set from a series of shortened data packets (e.g., shortened sequences of data satisfying inclusion criteria of the algorithm). Such piecewise construction of the data set may include stitching of adjacent data packets together to ensure smooth transitions for the model updater, or the like.

In aspects, the model updater or data collection algorithm may be configured to generate a collage of the data collected over time, the collage used in the adaptation process, overlapping portions of the collage used to validate the adaptation process, or the like.

In aspects, the system may include a test signal generator, configured so as to superimpose a diagnostic signal onto the audio stream, the diagnostic signal used to ensure the collected data meets the minimum requirements for the adaptation process in question (e.g., amplitude or spectral data as needed for the adaptation of one or more linear aspects or nonlinear aspects of the control model).

In aspects, the model updater, scheduler, or data collection algorithm may be configured to capture data from the audio stream during specific tests, touch feedback audio chimes, user notifications, system or application updates, wake-up chimes, ring tones, etc. In aspects, the system may be configured to add audio content into one or more of such audio streams, alter the stored audio streams, piecewise combine time independent audio streams, or validate the audio streams so as to confirm their use in a model update.

Such a configuration may be advantageous for ensuring known audio streams are used during the update process (e.g., to assist with repeatability, or robustness of the update process, etc.).

The system may be configured to accept pre-validated notifications, audio tests, touch feedback chimes, ring tones, wake-up chimes, and/or audio streams rendered during updates, gameplay, music feedback, etc. Whereby, the system may include a means for identifying a pre-validated audio stream (e.g., such as by acceptance of an accompanying validation indicator, etc.), and utilizing such identification to streamline storage of the dataset for use in a model update, select the model update type for use with the dataset, combinations thereof, or the like. In aspects, the identifier may include a numerical indication of the type of content within the pre-validated audio stream (e.g., low amplitude, broad spectrum, spectrum specific, large amplitude, etc.), the model updater and or scheduler configured to accept the identifier to direct the type of model update to be performed with the collected dataset.

In aspects, the model updater may include one or more algorithms for performing an update on one or more aspects of a model included in the controller. Such algorithms may include a non-recursive regression algorithm, a robust least squares algorithm, a model selection algorithm, or the like.

In aspects, the model updater or data collection algorithm may include a function for selecting data with which to train the system, including selection of data from a collected dataset with good spectral and working domain coverage, selection of data with limited repetition of signal (e.g., to prevent oscillation of the converging model to the plant), collection of piecewise continuous data which collectively satisfy such criteria, etc.

In aspects there is provided, a method for controlling a loudspeaker with a controller including batch estimating one or more model parameters from a dataset derived from an audio stream played by the controller, and updating one or more aspects of the controller with the estimated model parameters.

In aspects there is provided, a method for controlling a loudspeaker with a controller including batch testing one or more model estimates against a dataset collected from an audio stream played through the controller, determining a nearest fit model by comparing the model estimates to the collected data, and implementing the nearest fit model in the controller.

In aspects, the step of estimating may be performed by a robust regression algorithm. In aspects, the step of estimating may be performed by considering a difference between a parameter estimate derived from the controller output and a parameter measurement obtained via feedback from the loudspeaker during the same dataset. In aspects, the method may include determining if the dataset contains sufficient data for a linear model update, a nonlinear model update, a partial update, a diagnostic comparison, or the like and if so, updating one or more aspects of the controller appropriately based on the content of the dataset.

In aspects, the method may include selecting data with amplitude above a predetermined threshold and applying that data to the estimation of a nonlinear portion of a controller model. In aspects, the method may include selecting data with amplitude above a null threshold and below a predetermined threshold, and applying that data to the estimation of a linear portion of a controller model. In aspects, the method may include selecting data within a predetermined threshold over a bandwidth of interest. The method may include collecting data until a predetermined amount of data has been collected within the predetermined threshold and/or over a predetermined bandwidth of interest.

In aspects, the method may include collecting data during a notification, reboot, an update, chime, ring tone, or the like. The method may include receiving a notification that the audio stream is associated with known good data (e.g., that the audio stream contains data, such a notification, that contains the necessary data suitable for performing a model update). The model updater, data collection algorithm, scheduler, etc. may be configured to receive such notification and to initiate collection of data, or a model update process upon receipt thereof. In aspects, one or more notifications, ringtones, etc. may be prequalified so as to contain the necessary amplitude and frequency content desired for performing the model update. The notification may be provided to the system, model updater, etc. during periods when such audio streams are playing, so as to maximize collected data for updates, while minimizing user impact associated with the update process. Such a procedure may be advantageous for performing updates with minimal impact to users, particularly for updating large signal models (which a user may otherwise hear in order to collect the necessary data).

The method may include determining health state of the system during the estimation process. In aspects, the health state of the system may be determined by comparing one or more aspects of the adapted or estimated model against known failed or damaged states for the system (which may be stored locally or in a cloud, etc.). Such a failed state may be determined by identification of one or more parameters thereof lying outside of a safe operating manifold during the estimation process, by the nearest fit model being associated with a failed or damaged state, or the like.

The method may include generating an alert or notification, reporting the heath state, requesting servicing, or the like if the health state of the system indicates a failed or damaged state.

The method may include loading a safe mode model into the controller upon determination of a failed or damaged health state thereof. Such a safe mode model may be configured so as to limit audio output from the loudspeaker, thus preventing further damage there to, but allowing the associated device to continue rendering an audio stream until service repair may be performed.

The method may include comparing the goodness of fit between the newly estimated model and one or more feedback signals or signals or metrics generated therefrom, prior to updating one or more aspects of the controller with the newly estimated model. The method may include rejecting the newly estimated model of the comparison shows a substantial difference between the model prediction and the feedback signals or metrics.

According to aspects there is provided, a method for adapting a loudspeaker model including applying a test signal to the loudspeaker during a user notification to construct a dataset, batch estimating one or more aspects of a model from the dataset, and updating the model based on the batch estimation. In aspects, the user notification may be combined with a sleep recovery event, a device wakeup event, a reboot, a system notification, a ring tone, a touch audio response, or the like. In aspects, the system may be preloaded with one or more pre-approved user notifications, the preapproved user notifications including sufficient amplitude and frequency data such that a data set generated therefrom will contain sufficient information for the batch estimation.

In aspects, the model updater, scheduler, or data collection algorithm may be configured to acquire more than 0.1 s of continuous data from an associated audio stream prior to estimating a model parameter, more than 0.25 s of continuous data, more than 0.5 s of continuous data, more than is of continuous data. In aspects, the model updater, scheduler, or data collection algorithm may be configured to update a frequency band limited aspect of a model, the system configured to acquire more than 3× worth of continuous data needed to fill the desired frequency band, more than 6×, more than 10×, etc.

In aspects, one or more components of a system in accordance with the present disclosure may be configured to assess the frequency content of the collected data, and to assemble the data into a dataset in accordance with the frequency spectrum and amplitude content thereof, for use in a model update. The data for the dataset could be collected, so as to satisfy an amplitude and bandwidth spread, even from discontinuously available snippets. The snippets collectively may satisfy the model fitting requirements, and the model update may be performed with the snippets in parallel. In aspects, a data set may be constructed even with snippets that contain only data of limited frequency range, but collectively the dataset is populated with a full range of data for inclusion in the model update.

In aspects, the data may be selected based upon it having significant frequency content between f0/10 to 10*f0, f0/5 to 5*f0, f0/2 to 2*f0 or the like, optionally with additional power below f0 to get information suitable for a model update (where f0 is the first resonant frequency of the associated loudspeaker). The system may include a bandpass filter for estimating amplitude of the signal content from the audio stream in this range, the output of the bandpass filter made available to the model updater, scheduler, data collection algorithm, etc. in order to determine when the collected data is suitable for performing a model update procedure.

In aspects, the data may be piecewise assembled collection of snippets of continuous data extracted from the audio stream over a period of time. In general it may be advantageous to limit the piecewise nature of the assembled data in order to limit model mismatch during transition between pieces analyzed during a model update. In aspects, one or more of the snippets of data may be more than 50 ms in length, more than 100 ms in length, more than 250 ms in length, or the like.

In aspects, the data collection algorithm, buffer, model updater, or the like may be configured to ignore results obtained with the first data points in each snippet, so as to minimize lead-in errors associated with initial mismatch created during a model update process (e.g., when a piecewise assembled collection of snippets is used in the model update algorithm). Additionally, alternatively, or in combination the algorithm may be configured to adjust the best guess for the system between snippets, so as to enhance convergence during a model update. In aspects, the algorithm may be configured to represent or weight contribution from one or more particularly relevant snippets in the data more so than others, so as to enhance convergence during the model update. Some non-limiting examples of such weighting include, replicating particularly relevant snippets throughout the dataset (e.g., thus increasing the percentage of the relevant snippets in the overall dataset), by organizing snippets within the dataset so as to improve continuity (e.g., organizing snippets in the dataset so as to minimize the discontinuity between snippets), by windowing snippets with a known method (e.g., by applying an apodization function, a Hamming window, B-spline window, polynomial window, cosine window, Gaussian window, Kaiser window, combinations, derivatives, and hybrids thereof, or the like), etc. In aspects, a hybrid windowing function may be employed so as to tie snippets together while maintaining continuity there between. In one non-limiting example, a windowing function may be applied to snippets such that the values of the data points nearest to the ends of the snippets are pulled towards those of the adjacent snippets in the dataset (e.g., such as via a window that has a value of zero everywhere except near the ends of the snippet, where the window transitions towards the mean between the snippet endpoints, and the snippet and window(s) are added to create the continuous dataset). Thus the snippets may be replaced with a continuous dataset for use in a model update.

In aspects, the data collection function, buffer, or model updater may be configured to monitor incoming data to determine if a segment of the data is suitable for use in the model update. In one non-limiting example, the monitoring function may include a root mean square value test (e.g., to check the amplitude of the incoming data) and a spectrum check (e.g., to determine the spectral content of the incoming signal), so as to ensure the signal power in the captured data is sufficiently high for the type of module update to be performed (e.g., linear model update, versus a large signal model update, etc.). Such a spectrum check or combination of amplitude and spectrum check could be implemented in practice by a series of bandpass filters, a quadrature filter array, or the like compared with an amplitude comparison for each stage of the output therefrom. In aspects, the estimation may be computationally accelerated by limiting the estimation space to a predetermined range, the predetermined range based on the presently used parameters.

In aspects, an amplitude and/or spectrum validating function may be available as part of an associated loudspeaker protection system. Such functionality may be provided to reduce the necessary instructions per second while screening data for the model updater and providing functionality to the speaker protection system. In aspects, the amplitude and/or spectrum validating function may be coupled with a scheduler, model updater, data collection algorithm, or the like to validate what type or portion of a model may be updated with the data in a particular dataset. In one non-limiting example, data collection algorithm may be configured to analyze the characteristic amplitude range and/or spectral range of a collected dataset. Based upon the amplitude and/or spectral range, the algorithm may be configured to initiate a model update. Some non-limiting examples of selection criteria include, determining if the data includes amplitude content above a predetermined threshold through a spectrum of interest, and if so, applying that data to the estimation of a nonlinear portion of a controller model, determining if the data includes at least a subset with amplitude above a null threshold and below a predetermined threshold, and applying that data or a subset thereof to the estimation of a linear portion of a controller model, selecting data within a predetermined threshold over a bandwidth of interest and applying that data to estimation of a frequency dependent function, combinations thereof or the like. The data collection algorithm, model updater, and/or scheduler may include a validation function configured to determine when a sufficient amount of data has been collected within the predetermined threshold and/or over a predetermined bandwidth of interest. In aspects, such a function may be used to drive a model update function, a scheduler function, or the like.

In aspects, one or more components of the system, the model updater, etc. may be configured to accept a limited data set and to apply the limited data set repeatedly in sequence during an analysis thereof to perform a model update.

In aspects, the system may be configured to store one or more previously generated model parameters or values in memory, and to implement one or more stored parameters or values as an initial guess for a model update procedure. Such a configuration may be advantageous for improving the probability of a stable conversion of the estimation algorithm.

In aspects, the system, data collection algorithm, model updater, etc. may be configured to accumulate data for performing an update from an audio stream in accordance with the present disclosure. In aspects, the updater or algorithm may be configured to drop out data from the approved dataset after a prolonged period of time. Such data dropout may be conducted in order to limit the amount of old data from the dataset (e.g., in order to ensure that only recently collected data is used in the updating process). Such time sensitive data management may be achieved by storing a timestamp along with the collected data, and removing the data from the buffer after a predetermined period of time, if it has not been used in a model update, analysis, or the like.

In aspects, the system may be configured to monitor, measure, and/or estimate one or more operating conditions (e.g., such as voice coil temperature). The operating condition may be stored alongside the data, in the buffer. When appropriate data is culled for use in a model update, the present operating condition may be compared against the stored equivalents to assist with the selection of data for use in the model update. In aspects, the system may be configured to construct a model for particular operating conditions, for a series of operating conditions, for the most used operating conditions, etc. The system may be configured to collect data from the buffer for each of the bands of operating conditions over which a model is to be updated (e.g., to cull data from a range of temperatures, within a range of a set operating temperature, etc.)

In aspects, the collected data may be managed in relation to the operating condition. In one non-limiting example, if temperature data was collected along with audio data during the accumulation of continuous data snippets, but over the course of the collection, the temperature changed dramatically, the system may be configured to discard the data that corresponds to the old temperature reading (e.g., or save it by culling data into frequency/amplitude/temperature batches, each suitable for a different temperature based batch update of the model), capture only data relevant to the present temperature, or the like. The remaining or captured data may be directed to an associated model updater to perform an update of one or more aspects of the system therewith.

In aspects, the model updater may be configured to perform the adaptation process iteratively on the same dataset in order to achieve convergence of the model therewith. If the dataset is representative for the system these parameters as output from the model may more accurately reflect the properties of the loudspeaker. The model updater may include a validation function configured to test one or more of the parameters against a stored reference parameter, a model bank, etc. in order to determine if the results of the model update were completed satisfactorily (e.g., such as by confirming that one or more of the parameters is within a valid range, that the model is within a range of a predetermined model, etc.). Such a validation function may be applied prior to updating one or more models within the controller (e.g., as a safety check).

According to aspects there is provided, a method in accordance with the present disclosure for updating a model for a transducer in a device including, applying a test signal to the transducer during an event, a power-up, notification, ring-tone, wake-up, or a sleep recovery event on the device to form a test dataset, estimating one or more characteristics of transducer from the test dataset, and updating the model based on one or more of the estimated characteristics.

In aspects, the method may include batch estimating one or more of the characteristics, generating one or more portions of the dataset from multiple events, predicting a future model or scheduling of model updates from the trend in the estimated characteristics from one or more previous updates, predicting the lifetime of the loudspeaker, combinations thereof, or the like.

In aspects, the event may provide an audible and/or tactile feedback to a user (e.g., the signal can serve as both the data input for adaptation as well as for a user notification, ring-tone, etc.), the event may be pre-validated such that it is known to contain suitable data for an update, etc.

FIG. 1 shows a schematic diagram of aspects of a nonlinear control system in accordance with the present disclosure. The nonlinear control system includes a controller 110 configured to accept an input signal 1 from an audio source (not explicitly shown) and one or more updates 165. The controller 110 may be configured to accept one or more updates 165 such as parameters, coefficients, lookup tables, models, pointers to models or components thereof in a model bank, or the like. The system may include a model updater 150, configured to generate the updates 165. The controller 110 may generate one or more control signals 115 to drive an associated audio amplifier 120. In aspects, one or more controller generated signals 131 (e.g., one or more of the control signals 115 and/or signals generated therefrom) may be fed to the model updater 150 or a buffer 140 connected thereto for inclusion into a model update process to produce one or more of the updates 165. In aspects, the controller generated signals 131 may be produced as a byproduct of the rendering of an audio stream and may be utilized in the model updater 150 in order to save processing requirements in generating one or more of the updates 165.

In aspects, the audio amplifier 120 may be configured to produce one or more amplifier feedback signals 133, which may be directed to the model updater 150 or to an associated buffer 140 for use in generating one or more of the updates 165.

The audio amplifier 120 is configured to accept one or more of the control signals 115 and produce an audio signal 125 to drive a transducer 130 (e.g., a loudspeaker). In aspects, the transducer 130 may be equipped with a feedback sensor to communicate a transducer feedback signal 135 to the model updater 150 or to an associated buffer 140 for use in generating one or more of the updates 165.

By transducer 130 is meant a component or device such as a loudspeaker suitable for producing sound (e.g., an audio signal 3). A transducer 130 may be based on one of many different technologies such as electromagnetic, thermoacoustic, electrostatic, magnetostrictive, ribbon, audio arrays, electroactive materials, and the like. Transducers 130 based on different technologies may require alternative driver characteristics, matching or filtering circuits but such aspects are not meant to alter the scope of this disclosure.

In aspects, the system may include one or more sensors 137 (e.g., microphones, temperature sensors, humidity sensors, pressure sensors, etc.) arranged in the vicinity of the transducer 130, configured to monitor an output 3 and/or an ambient condition and to generate a sensor feedback signal 139 to the model updater 150 or to an associated buffer 140 for use in generating one or more of the updates 165.

In aspects, the audio amplifier 120 may include a half bridge, a full bridge configuration, and/or may accept one or more control signals 115, PWM signals, or the like to drive either corresponding high and low side drivers. The audio amplifier 120 may include a class D amplifier, a balanced class D amplifier, a class K amplifier, or the like. The audio amplifier 120 may include a feedback circuit for determining a current flow, voltage, etc. delivered to the transducer 130 during use. The amplifier may include a feedback loop, optionally configured to reduce or compensate for one or more nonlinearities in one or more transducers 130 and/or the electrical components in the system.

The audio amplifier 120 may include one or more sensory circuits to generate an amplifier feedback signal 133. In aspects, the may include a power signal, a current signal, an impedance measurement (e.g., a spectral measurement, a low frequency measurement, etc.), a voltage signal, a charge, a field strength measurement, or the like.

In aspects, the audio amplifier 120 may be configured to monitor one or more aspects of the impedance of an associated transducer 130. The impedance may be measured so as to establish a substantially DC impedance (e.g., a loudspeaker impedance as measured in subsonic spectrum) measurement of the loudspeaker, which may be at least partially indicative of a characteristic temperature of the loudspeaker coil. The impedance may be measured in combination with a current sensing resistor, in combination with a measurement of the voltage applied to the loudspeaker.

In aspects, pertaining to an audio amplifier 120 implementation with a class-D amplifier, the loudspeaker impedance may be calculated from the output current of the class-D amplifier. The current may be pulsed along with the ON-OFF cycles associated with the amplifier. Thus, a relevant current signal may be obtained by low pass filtering the output current. The filter may be configured so as to obtain one or more spectral components of the current signal. In one non-limiting example, the impedance spectrum may be assessed in order to determine the frequency of the first resonant mode of the loudspeaker, and/or the impedance at the peak of the first resonant frequency. As the impedance or associated frequency of the first resonant peak may change in association with the excursion of the coil and/or the temperature of the coil. A comparison of the impedance measured at the resonant peak with that of in the sub-sonic spectrum may be employed to extract substantially independent measurements of the excursion and the coil temperature during use.

The impedance of the transducer 130 may be measured at the audio amplifier 120, for use in matching one or more control parameters, for use within the model updater 150, or model parameters to the physical system of the immediate example (e.g., the impedance may be used during optimization of one or more aspects of a model within the controller 110).

The system may include one or more buffers 140, 160 each buffer configured to accept and store one or more signals to be delivered to one or more subsystems (e.g., the controller 110, the model updater 150, etc.), as needed during a model update, dataset analysis, etc. In aspects, the buffers 140, 160 may be configured as FIFO buffers, caches or the like, with significant memory allocation so as to temporarily store a stream of data associated with the audio stream during use. The buffers 140, 160 may also act as storage for data and/or model updates to be sent as model input data 145 to the model updater 150 and to the controller 110 as updates 165 respectively. The model updater 150 may be configured to send one or more model updates 155 to the associated buffer 160 or controller 110 (e.g., in light of a buffer 160 present in a particular implementation).

One or more components of the system may operate at one or more rates. In aspects, such operating rates may be dictated by a scheduler in accordance with the present disclosure. One or more components may be operated at a first rate 170, such as a high frequency rate, suitable for rendering an audio stream. In aspects, one or more of the components (e.g., a model updater 150, a buffer 140, 160, etc.) may be configured to operate at a second rate 180, suitable for a lower or intermediate rate associated with model updates. In aspects, the model updater 150 may be configured to produce model updates or portions thereof at both intermediate and/or lower rates, depending on the aspects of the model being updated, or changes in an operating condition (e.g., as measured by a feedback signal 131, 133, 135, 139, an ambient signal measurement, etc.), or the like.

The controller 110 may include a control strategy and associated model based upon one or more of adaptive control, hierarchical control, neural networks, Bayesian probability, backstepping, Lyapunov redesign, H-infinity, deadbeat control, fractional-order control, model predictive control, nonlinear damping, state space control, fuzzy logic, machine learning, evolutionary computation, genetic algorithms, optimal control, model predictive control, linear quadratic control, robust control processes, stochastic control, feed forward control, combinations thereof, and the like. The controller 110 may include a full non-linear control strategy (e.g., a sliding mode, bang-bang, BIBO strategy, etc.), a linear control strategy, or a combination thereof. In one non-limiting example, the controller 110 may be configured in a fully feed-forward approach (e.g., as an exact input-output linearization controller). Alternatively, additionally or in combination, one or more aspects of the controller 110 may include a feed-back controller (e.g., a nonlinear feedback controller, a linear feedback controller, a PID controller, etc.), a feed-forward controller, combinations thereof, or the like.

A controller 110 in accordance with the present disclosure may include a band selection filter (e.g., a bandpass, low pass filter, etc.) configured so as to modify the input signal 1 to produce a modified input signal (e.g., an input signal with limited spectral content, spectral content relevant to the nonlinear control system only, etc.). In one non-limiting example, the controller 110 may include a filter with a crossover positioned at approximately 100 Hz, 500 Hz, 800 Hz, or the like. The nonlinear control may be applied to the spectral content below the cross over while the rest of the signal may be sent elsewhere in the system, enter an equalizer, etc. The signals may be recombined before being directed towards the audio amplifier 120. In a multi-rate example, the signals maybe downsampled and upsampled accordingly, based on their spectral content and the harmonic content added by the nonlinear controller 110 during operation. Such a configuration may be advantageous for reducing the computational load on the control system during real-time operation.

The model updater 150 and/or portions of the controller 110 may include an observer and/or a state estimator. A state estimator (e.g., an exact linearization model, a feed forward model, etc.) may be configured to estimate one or more of the updates 165 for input to the controller 110. In aspects, the state estimator may include a state space model in combination with an exact input-output linearization algorithm in order to achieve this function, among other approaches. One or more aspects of a model within the model updater 150 or an associated model in the controller 110 may be based upon a physical model (e.g., a lumped parameter model, etc.). Alternatively, additionally, or in combination, one or more aspects of the model may be based upon a general architecture (e.g., a black box model, a neural network, a fuzzy model, a Bayesian network, etc.). The model may include one or more parametrically defined aspects that may be configured, calibrated, and/or adapted to better accommodate the specific requirements of the given application.

In aspects, one or more feedback signals 131, 133, 135 may be obtained from one or more aspects of the audio amplifier 120, controller 110, and/or transducer 130. Some non-limiting examples of feedback signals 131, 133, 135 include one or more temperature measurements, impedance, drive current, drive voltage, drive power, one or more kinematic measurements (e.g., membrane or coil displacement, velocity, acceleration, air flow, etc.), sound pressure level measurement, local microphone feedback, ambient condition feedback (e.g., temperature, pressure, humidity, etc), kinetic measurements (e.g., force at a mount, impact measurement, etc.), B-field measurement, combinations thereof, and the like.

The updates 165 may be generally be provided as input to the controller 110 so as to update one or more models or portions thereof as part of an update process. In aspects, the updates 165 may be transformed so as to reduce computational requirements and/or simplify calculation of one or more aspects of the system or for simplified integration into a model included within the controller 110.

In aspects, the control signals 115 may be delivered to one or more aspects of the audio amplifier 120 (e.g., to a driver included therein, to a loudspeaker included therein, etc.).

A model included in the controller 110, model updater 150, or an associated model bank may include an observer (e.g., a nonlinear observer, a sliding mode observer, a Kalman filter, an adaptive filter, a least means square adaptive filter, an augmented recursive least square filter, an extended Kalman filter, ensemble Kalman filter, high order extended Kalman filters, a dynamic Bayesian network, etc.). In aspects, the model may be an unscented Kalman filter (UKF). The unscented Kalman filter may be configured to accept one or more feedback signals 131, 133, 135, the input signal 1, and/or the control signal 115. The unscented Kalman filter (UKF) may include a deterministic sampling technique known as the unscented transform to pick a minimal set of sample points (e.g., sigma points) around the mean nonlinear function. The sigma points may be propagated through the non-linear functions, from which the mean and covariance of the estimates are recovered. The resulting filter may more accurately capture the true mean and covariance of the overall system being modeled. In addition, UKF do not require explicit calculation of Jacobians, which for complex functions may be challenging, especially on a resource limited device.

In aspects, the control signal 115 may include an amplified, optional compressed signal related to the input signal 1 associated with the audio stream as generated by the controller 110. Such a control signal 115 may be directed into the model updater 150 for use in the generation of a model update 165.

One or more of the optional controller generated signals 131 (e.g., one or more of the control signals 115, intermediate signals generated within the controller 110, and/or signals generated therefrom) may take one of several forms. Some non-limiting examples of such forms include a loudspeaker impedance estimate, a loudspeaker impedance spectral estimate (e.g., as generated by a function associated with a model in the controller 110), a partially adjusted signal (e.g., a signal having passed through a portion of the controller 110), a delayed signal, a non-delayed signal, a prefiltered signal, a portion of a signal corresponding to a spectral range of interest, a linearly compensated signal (e.g., a signal having not yet passed through a nonlinear portion of the controller 110), a nonlinearly compensated signal, one or more model parameters, one or more estimates generated by a model, combinations thereof, or the like.

One or more of the optional amplifier feedback signals 133 may take the form of a current feedback signal (e.g., related to a voice coil impedance), a voltage feedback signal, an impedance, a conductance, a substantially DC impedance value (e.g., related to a voice coil temperature), a resonant property (e.g., a resonant frequency, a resonant frequency bandwidth, a resonant frequency acoustic quality factor, etc.), an amplifier temperature, combinations thereof, or the like.

One or more of the optional transducer feedback signals 135 may be related to a loudspeaker state. Some non-limiting examples include, a voice coil current, a voice coil temperature, one or more kinematic measurements (e.g., membrane or coil displacement, velocity, acceleration, air flow, a chamber back pressure, vent airflow, etc.), a sound pressure level measurement, a kinetic measurement (e.g., force at a mount, impact measurement, etc.), a B-field measurement, combinations thereof, and the like.

One or more of the optional sensor feedback signals 139 may be related to feedback from a local microphone feedback, ambient condition feedback (e.g., temperature, pressure, humidity, etc.), combinations thereof, or the like.

Such feedback may be integrated into the model update process within the model updater 150, provided as feedback to the controller 110, or the like as needed for a particular implementation.

In aspects, one or more such feedback signals may be updated at the first rate 170. Alternatively, additionally, or in combination, one or more such signals may be updated at the second rate 180 or a rate associated therewith.

Optionally, one or more of the updates 165 may be stored in the buffer 160, and may be communication 195 to the input buffer 140 and/or model updater 150 if needed in part of a feedback or model updating process. Such communication 195 may be performed at the second rate 180 or an alternative rate as the updates 165 would not need to be transferred or analyzed at a rate suitable for rendering the audio stream.

Figure 2A:
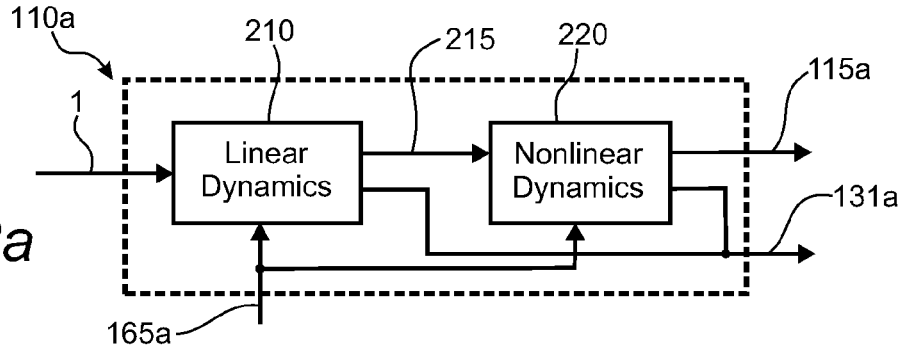
FIGS. 2*a-b* show schematic diagrams of aspects of a controller in accordance with the present disclosure.
Figure 2B:
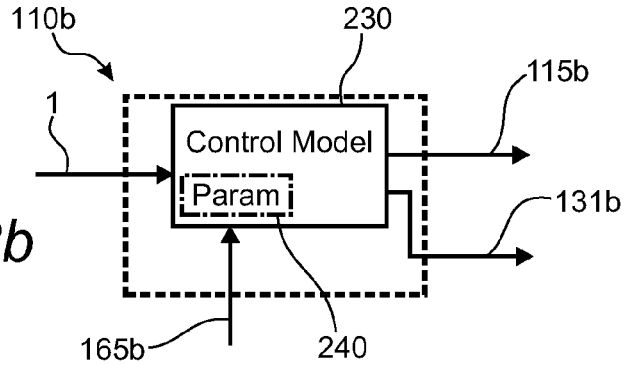

FIGS. 2*a* and 2*b* show schematic diagrams of aspects of a controller in accordance with the present disclosure. FIG. 2*a* shows aspects of a feed-forward implementation of the controller 110 in accordance with the present disclosure. The feed-forward controller 110*a* may be configured to accept an input signal 1 and one or more updates 165*a*, and to generate one or more control signals 115*a*. Optionally, the feed-forward controller 110*a* may be configured to output one or more controller generated signals 131*a* each in accordance with the present disclosure.

In the configuration shown, the feed-forward controller 110*a* includes a linear dynamics compensating function 210 configured to accept the input signal 1 or a signal derived therefrom (e.g., a modified input signal), and one or more updates 165*a*, or signal derived therefrom (e.g., a modified state vector, a model coefficient, a pointer, one or more model parameters, etc.), and configured to generate a linear compensated signal 215. In aspects, the linear dynamics compensating function 210 may be configured so as to provide a desired transformation for the input signal 1 (e.g., an equalizer function, a compressor function, a linear inverse dynamic function, additional added harmonics, etc.).

The feed-forward controller 110*a* may include a nonlinear dynamics compensating function 220 configured to compensate for one or more non-linear aspects of the audio system (e.g., one or more nonlinearities associated with the loudspeaker, the audio amplifier 120, the enclosure, etc.). The nonlinear dynamics compensating function 220 may be configured to accept the linear compensated signal 215, one or more updates 165*a* or one or more signals derived therefrom (e.g., a modified state vector, a model coefficient, a pointer, one or more model parameters, etc.), and configured to generate one or more control signals 115*a*.

Optionally, the feed-forward controller 110*a* may be configured to output one or more controller generated signals 131*a* each in accordance with the present disclosure, from one or more of the linear dynamics compensating function 210, the nonlinear dynamics compensating function 220, a linear compensated signal 215, a control signal 115*a*, or a signal generated therefrom (e.g., such as via an impedance or displacement estimating function, not explicitly shown).

In aspects, one or more of the linear dynamics compensating function 210 or the nonlinear dynamics compensating function 220 may include a black or grey box model, a parametric model (such as the lumped parameter model outlined herein), a phenomenologically based model, combinations thereof, or the like. Thus, the system may include a pure "black-box" modeling approach (e.g., a model with no physical basis, but rather a pure input-to-output behavior mapping that can then be compensated for), or a physically based, parametrically defined model. In some instances, a physically targeted model may reduce the computational load on the nonlinear control system and/or improve stability of a model updating process in accordance with the present disclosure.

In aspects, the controller 110, 110*a* (e.g., a non-limiting implementation of a controller 110, a feed-forward controller 110*a*, a function 210, 220 included therein, etc.) may include a protection function (not explicitly shown), configured to accept one or more input signals 1 and one or more updates 165*a* and optionally produce one or more linear compensated signals 215, or control signals 115*a*, and/or a flag (e.g., an alert or notification, not explicitly shown). The protection block may be configured to compare one or more aspects of the input signal 1, the update 165*a*, a state related thereto, or one or more signals generated therefrom (e.g., an input power signal, a state power signal, a thermal state, cone excursion, a thermal dynamic, a thermal approach vector, etc.). The protection block may be configured to compare such information against a performance limitation criteria (e.g., a thermal model, an excursion limitation, a power consumption limitation of the associated device [e.g., a configurable criteria], etc.) to determine how close the operating condition of the audio system is to a limit, the rate at which the operating state is approaching a limit (e.g., a thermal limit), etc.

Such functionality may be advantageous for generating a look a-head trajectory for smoothly transitioning system gain, performance aspects, etc. so as to remain within the limitation criteria as well as reduce the probability of introducing audio artifacts based when applying limits to the system.

In aspects, the protection function may be configured to generate such information in terms of an alert (e.g., a warning flag, a problem flag, etc.), the alert configured so as to indicate a level of severity to one or more aspects of the control system, to assist with parametrically limiting the output of one or more aspect of the control system, etc. Alternatively, additionally, or in combination, the protection function may be configured to directly augment the input signal 1, one or more of the states, selecting a "failsafe" model for implementation in one or more of the control functions, or the like so as to generate a modified linear compensated signal 215, a modified control signal 115*a*, a modified state vector, or the like, so as to provide the protection aspect without addition computational complexity to other aspects of the control system.

In aspects, the controller 110, 110*a* may include a compressor and/or a limiter (e.g., included in the nonlinear dynamics compensation function 220, etc.) configured to accept an intermediate signal 215, 115*a*, etc., one or more states, one or more updates 165*a*, or signals generated therefrom (e.g., a modified state vector, an impedance estimate, a projection of an output forward in time, a displacement projection, etc.), and/or an alert in accordance with the present disclosure. The limiter may be configured to limit the intermediate signal 215, 115*a* based on one or more aspects of the states, updates 165*a*, one or more aspects of an intermediate signal 215, 115*a*, an alert, combinations thereof, and the like. The limiter may be configured to generate a modified and/or limited control signal 115*a* for use by one or more components in the control system. In aspects, the limiter may be implemented as a compressor, with a limit configured based upon a predetermined criteria and/or an alert.

In aspects, one or more of the model updater 150, the controller 110, 110*a*, 110*b*, or a component thereof may include an observer configured so as to capture and/or track the first resonant peak of the transducer 130 (e.g., of an associated loudspeaker). The observer may include one or more algorithms (e.g., a frequency tracking algorithm based on an unscented Kalman filter, AUKF, etc.) configured to extract the first resonant peak from one or more aspects of the control signal 115 and/or the feedback signal 131, 133, 135, 139. Additionally, alternatively, or in combination, the algorithm may be configured to calculate a loudspeaker impedance parameter at the fundamental resonant peak. In aspects, the observer may be configured so as to be selectable, modifiable, etc. with an update 165 provided by the model updater 150. Such an algorithm may be advantageous for performing function such as frequency extraction and/or impedance measurement in real-time amongst a general audio stream (e.g., during streaming of music, voice, etc.). With such information available, one or more controllers in the nonlinear control system may be configured to compensate for the resonant peak during operation. Such action may be advantageous to dramatically increase drive capability of the associated loudspeaker without the need to impart mechanically damped solutions to the problem (e.g., by directly compensating, a high efficiency solution may be attained).

FIG. 2*b* shows aspects of a controller 110*b* in accordance with the present disclosure. The controller 110*b* includes a control model 230. In FIG. 2*b*, the control model 230 is implemented as a feed-forward controller 230 configured as a nonlinear input-output linearizing controller. The feed-forward controller 230 may effectively linearize the system nonlinearities, thus providing a substantially modified control signal 115*b*, compensated so as to produce a linearized output 3 on an associated transducer 130. In aspects, the feed-forward controller 230 may include one or more parametric models, the parameters 240 of which may be alterable by the update 165*b*. In aspects, a generally defined parametric system model may be derived, pertaining to the specific implementation of the nonlinear control system (e.g., covering a class of transducers 130 for which the controller 110, 110*a*, 110*b* will be associated with). In aspects, the feed-forward controller may be directly derived from the parametric model so as to cancel substantial nonlinear aspects of the transducer 130 in the overall signal pathway.

For purposes of discussion, a non-limiting example of a suitable continuous time implementation of a feed forward control law in accordance with the present disclosure is given in Equation 1:

$$
\begin{aligned}
u = \Bigg\{ & Mv + \frac{x_2}{C_{ms}(x_1)}\left(1 - \frac{x_1}{C_{ms}(x_1)} \cdot \frac{dC_{ms}(x_1)}{dx_1}\right) + \\
& \frac{R_{ms}}{M}\left(\frac{-x_1}{C_{ms}(x_1)} - R_{ms}x_2 + \right. \\
& \left.\left(Bl(x_1) + \frac{1}{2} \cdot \frac{dL_e(x_1)}{dx_1}x_3\right)x_3 + \frac{1}{2} \cdot \frac{dL_2(x_1)}{dx_1}x_4^2\right) - \\
& x_2x_3\frac{dBl(x_1)}{dx_1} - \frac{1}{2}x_2x_3^2\frac{d^2L_e(x_1)}{dx_1^2} - \\
& \frac{1}{2}x_2x_4^2\frac{d^2L_2(x_1)}{dx_1^2} - \frac{x_4}{L_2(x_1)} \cdot \frac{dL_2(x_1)}{dx_1} \\
& \left(R_2(x_1)x_3 - \left(R_2(x_1) - x_2\frac{dL_2(x_1)}{dx_1}\right)x_4\right)\Bigg\} \cdot \\
& \left(\frac{L_e(x_1)}{Bl(x_1) + x_3\frac{dL_e(x_1)}{dx_1}}\right) + Bl(x_1)x_2 + \\
& x_2x_3\frac{dL_e(x_1)}{dx_1} + R_ex_3 + R_2x_3 - R_2x_4
\end{aligned}
\qquad \text{Equation 1}
$$

Equation 1 demonstrates a parametrically defined control law based upon the loudspeaker model known in the art. The states within the control law are represented in the Equation 1 as $x_1, \ldots, x_4$. The control law is of lower order than the states, thus a transformation may be used to accommodate any zero dynamics associated with this implementation.

The loudspeaker model associated with Equation 1 may include amplitude dependent parametrically defined lumped parameter aspects of physically identifiable components within the system. Relevant nonlinearities are introduced via spatially dependent parameters in the lumped parameter equations. In practice, thermal dependence may be added to accommodate for changing compliances, offsets, magnetic properties, etc. without changing the scope of the discussion.

The model as shown extends upon the theoretically accepted small displacement model proposed by Thiele and Small, and generally describes the eddy currents that occur at higher frequencies, more accurately than that proposed by Thiele and Small.

The terminal voltage is given by u(t), driver current by i(t) and coil displacement by x(t). The parameters Re, Bl(x), Cms(x), and Le(x) are dependent upon the coil displacement as well as the voice-coil temperature. The impedances represented by R2(x) and L2(x) may also be non-linear and of similar character to Le(x) but are generally influenced by different spectral aspects of the system (generally demonstrate significant nonlinearities in the higher frequency spectrum). In some simplifications, the functions R2 and L2 may be considered constant. The functions Bl(x), Cms(x) and Le(x) may be determined by a range of methods for the loudspeaker associated with a particular application. In general, the nonlinearities may be represented by temperature dependent polynomials, targeted functional representations or the like. For purposes of discussion, the functions Bl(x), Cms(x) and Le(x) were fitted using a known experimental method at room temperature.

For purposes of discussion, each of the functions may be fitted to experimental data using polynomial functions. More realistic fits may be implemented in order to maintain goodness of fit outside of the physically relevant range. Such extended goodness of fit may improve observer stability, adaptive algorithm stability, etc. in that such systems may temporarily extend into unrealistic conditions during the optimization and/or tracking process.

Many of the parameters may be temperature dependent. Some examples that are known to be affected by the voice-coil temperature when working in the large signal domain are considered to be Re, Bl(x), Cms(x) and Le(x).

The proposed equations may be put together into a general state-space form given by Equation 2:

$$
\dot{x} = \begin{bmatrix}
0 & 1 & 0 & 0 \\
\frac{-1}{MC_{ms}(x_1)} & \frac{-R_{ms}}{M} & \frac{Bl(x_1) + \frac{1}{2}\frac{dL_e(x_1)}{dx_1}x_3}{M} & \frac{\frac{1}{2}\frac{dL_2(x_1)}{dx_1}x_4}{M} \\
0 & \frac{Bl(x_1) - \frac{dL_e(x_1)}{dx_1}x_3}{L_e(x_1)} & \frac{-R_e(T_v) - R_2(x_1)}{L_e(x_1)} & \frac{R_2(x_1)}{L_e(x_1)} \\
0 & 0 & \frac{R_2(x_1)}{L_2(x_1)} & \frac{-R_2(x_1) - \frac{dL_2(x_1)}{dx_1}x_2}{L_2(x_1)}
\end{bmatrix} x + \begin{bmatrix} 0 \\ 0 \\ \frac{1}{L_e(x_1)} \\ 0 \end{bmatrix} u
\qquad \text{Equation 2}
$$

The force factor Bl(x) is represented with a maximum value when the coil displacement is near to the resting value (zero). Polynomial, Gaussian, spline, Lorentzian, Voigt, or alternative methods or fitting functions may be employed to ensure all force factor values maintained are realistic. In aspects, such fitting may be achieved by implementation of one or more of regression, segmented regression, iterative techniques, Gauss-Newtown algorithms, gradient methods, or the like.

The suspension compliance Cms(x) varies with temperature and may be subject to a range of nonlinear hysteretic effects as discussed herein.

The suspension impedance will increase when the cone leaves the equilibrium position, hence Cms(x) may be reduced outside the equilibrium. Thus the compliance and the force factor may share many of the same characteristics. In aspects, a suspension compliance function generated using polynomials, Gaussian sums, or another curve fitting approach may be fitted to the experimental data for use in the nonlinear control system.

The voice-coil inductance Le(x) may have significant displacement dependency but does not generally share characteristics with the force factor and the suspension compliance. Generally speaking, the inductance will increase when the voice-coil moves inwards and decrease when it moves outwards. This is due to the magnetic field created by the current passing through the voice-coil. This function may further experience one or more hysteretic aspects discussed herein. In aspects, the voice-coil inductance may be fitted to experimental data using a series of Gaussian sums or the like.

The stiffness of a loudspeaker suspension, k relates to the restoring force applied upon a deformed membrane to keep the voice coil in place and to move it back to its rest position, loudspeakers use a suspension system which creates a restoring force $F=k(x_d)*x_d$, which defines the stiffness as a function of the displacement $x_d$. Typically, the stiffness function has a minimum at $x_d=0$ and increases with higher displacement, but in the case of micro loudspeakers the stiffness function may be asymmetric (e.g., generally increasing with forward displacement and decreasing with rearward displacement). The characteristic shape of the stiffness for a micro loudspeaker may be represented by a constant value (linear case), a linear function of $x_d$ (causing the restoring force to be nonlinear), or a higher order function of $x_d$ (e.g., such as may be fitted by a method in accordance with the present disclosure). In aspects, the stiffness may change with aging, humidity, temperature (e.g., both aspects being related to the types of material in the suspension of the loudspeaker, the ambient conditions, storage conditions, amount of usage, etc.), or the like.

In aspects, a model in accordance with the present disclosure may include one or more terms representing a mechanical resistance $R_{ms}(x'_d)$ which may depend on the velocity of the voice coil ($x'_d$), may be nonlinearly related thereto, may be asymmetric, or the like. In general, for a loudspeaker, the mechanical resistance may depend upon the velocity of the voice coil created by the air that flows through rear-side vents of the loudspeaker, turbulence caused by airflow around the speaker, back pressure changes at extreme amplitudes, flow conditions caused by a leak (e.g., in some implementations leaks may not manifest themselves until the unit is operated at larger amplitudes), combinations thereof, and the like.

At a basic level, the mechanical resistance may be modeled using a function fitted to data or estimated by one or more methods or systems in accordance with the present disclosure.

In aspects, a system in accordance with the present disclosure may include a sound feedback sensor (e.g., a microphone, a pressure sensor, an enclosure based pressure sensor), a flow sensor (e.g., a sensor configured for measuring one or more aspects of airflow around the transducer, etc.), combinations thereof, or the like, adapted for measuring one or more aspects of the mechanical flow resistance during the rendering of an audio stream.

The system or one or more components thereof may include a data collection algorithm configured to determine the integrity of the data recorded during the rendering of an associated audio stream. The data collection algorithm may be configured to assess, one or more causal relationships between the input signal and one or more feedback signals across the dataset, so as to determine if one or more snippets within the dataset is suitable for a model update, corrupted by one or more disturbances, etc. In one non-limiting example, causality may be assessed by inclusion of a change detection algorithm, the algorithm configured to analyze one or more model state predictors (e.g., a model within a model bank, one or more aspects of the controller, etc.) against a measured state (or state approximated by combinations of one or more measurements), over the captured dataset. Such an algorithm may be used to designate time periods over which the data is substantially free from disturbance, abrupt changes (e.g., free from abrupt changes in the transducer properties, environment, etc.), or the like. Such time periods may be identified by the algorithm such that a model updater in accordance with the present disclosure can process an updated model from the known good portions of the dataset.

Some non-limiting examples of algorithms that may be adapted for use herein as causality, disturbance, and/or change detection algorithms include a statistical whiteness test, multiple parallel slow-fast filters, multiple parallel operating prediction algorithms, change point estimation, residual generation and/or assessment techniques, stop rule approaches, residual integration tests, recursive least squares, robust least squares, least mean squares, a plurality of Kalman filters, a likelihood of change based method, a root-mean square parameter estimation error function, segmented noise variance function, an exponential forgetting window, a geometric moving average, etc. Such approaches essentially allow for the separation of the stochastic portion of a signal or model from the deterministic (causal) component of the signal or model. After separation, one or more criteria or thresholds associated with the model may be used to determine changes in the system, detection of a disturbance, fault detection, location of a disturbance, detection of a change free period of time over which the collected data may be used to perform a model update in accordance with the present disclosure, or the like.

In one non-limiting example, a multi-model residual estimating algorithm implemented to test the residual within slow and fast changing models of the controller. If no disturbance or change in the system is evident, the residual will be minimized over a time period of the analysis. If the residual changes over a time period, the causality detection algorithm may generate a change indication, disturbance indication, etc. An associated model update algorithm, or scheduler may be configured to accept the indication and execute or hold off on performing a model update (e.g., depending on the particular implementation).

Some criteria used to assess the causality between input and feedback signals, presence of a disturbance, and/or property change in the transducer include, change assessment between one or more models in the detection algorithm (e.g., change detection between parallel operating slow-fast criteria, etc.), cumulative sum (CUSUM) tests, stopping rule tests, maximum likelihood assessment, likelihood ratio tests, square residual threshold tests, assessment of residuals between slow-fast models, amplitude comparison between input and output across frequency bands of interest, comparison between signals over different frequency bands, inclusion of a fault isolation model (e.g., one or more models designed so as to highlight one or more failure models expected by a particular implementation), changes such relationships over time, "closeness of fit" comparison between the existing model use in the rendering process and measurements obtained from the feedback signals, quality of fit comparison between estimates and measurements, comparison of differential and/or integral relationships between input, controller generated signals, and/or feedback signals, or signals generated therefrom, combinations thereof, or the like. The system may include a plurality change estimators, optionally including a fast tracking estimator (e.g., to rapidly identify a change in one or more of the input/feedback relationships), and a relatively slow tracking estimator (e.g., to identify slowly changing input/feedback relationships, changes in environment, changes in slow moving states, etc.).

The causality detection algorithm may include one or more thresholds for determining when a non-white noise time period (e.g., a time period wherein a change is detected, a disturbance is detected, etc.). Such thresholds are to be determined as part of a particular implementation.

In aspects, the causality detection algorithm may compare relationships or models between input and one or more feedback stages (e.g., such as a voice coil current feedback signal) to determine if a change in one or more loudspeaker properties has occurred, but may compare between one or more of the input, feedback states (e.g., such as a microphone feedback signal) to determine the presence of a disturbance (e.g., so as to determine if certain feedback signals, such as from a microphone, can be trusted as part of a model update process), etc. Such an approach may be advantageous in a system where particular feedback signals may be less prone to disturbances (e.g., such as impedance or current feedback), while other signals may be prone to disturbance but include additional system information not available from other feedback signals (e.g., such as from an enclosure based pressure sensor, microphone, etc.). Such a configuration may be advantageous for balancing between obtaining precise modeling of system parameters and minimizing false alarms or poorly timed model updates during periods of change, disturbance, etc.

In aspects, the loudspeaker characteristics may be at least partially identified by monitoring the impedance thereof during a series of test procedures. Depending on the spectrum and amplitude of the input control signals, it may be possible to analyze the speaker over a range of different frequencies.

A discrete time implementation of a control law may be derived for a given system. Given that the sample frequency is high enough compared to the rate of change in the voice coil or diaphragm displacement $x_d$, simplifying approximations in the force factor and stiffness can be applied to an associated loudspeaker model. Under such conditions, simplifying approximations for the force factor and stiffness $Bl(x_d[n])\approx Bl(x_d[n-1])$ and $k(x_d[n])\approx k(x_d[n-1])$ may be made.

A resulting discrete time model can be derived for the diaphragm position $x_d[n]$ as shown below:

$$x_d[n] = \frac{\sigma_x Bl(x_d[n-1])}{R_e} u[n-1] \ldots + a_0 \frac{\sigma_x Bl(x_d[n-1])}{R_e} u[n-2] \ldots - \left(\frac{\sigma_x Bl(x_d[n-1])^2}{R_e} \frac{2}{T_s} + a_1 + a_0 + \sigma_x k(x_d[n-1])\right) x_d[n-1] \ldots - \left(-\frac{\sigma_x Bl(x_d[n-1])^2}{R_e} \frac{2}{T_s} + a_0 a_1 + a_2 + \sigma_x a_0 k(x_d[n-1])\right) \quad \text{Equation 3}$$

-continued $$x_d[n-2] \ldots - a_0 a_2 x_d[n-3]$$

Where $T_s$ is the sampling period, $a_k$ are model coefficients, $R_e$ is the pseudo DC voice coil impedance, a is a characteristic gain of a discrete physical position function, Bl(x) and k(x) are functions for the force factor and stiffness associated with the speaker respectively. All values in the discrete-time model shown in Equation 3 can be calculated from the parameters of the model in continuous time by matching the poles of the mechanical part of the system.

One or more of the states may be provided by a state estimator, included in the control model 230 or a model updater 150 in accordance with the present disclosure. The comparison between a measurable state (e.g., such as by current and/or voltage to estimate displacement, feedback from a microphone, direct measurement of loudspeaker membrane displacement, etc.) with an output from the model, may be used in a model updating process in accordance with the present disclosure. The model updating process may be used to determine one or more parameters, functions, or the like included in the model in accordance with the present disclosure.

One or more parameters 240 in the model, may be stored within the feed-forward controller 230 (e.g., within a parameter allocated space), any may be adjusted by the updates 165*b* in accordance with the present disclosure.

In aspects, the control model 230 may include one or more state estimating function, the output of which may serve as a controller generated signal 131*b* for use in future updates, by a scheduler to determine when an update should be performed, or the like.

FIGS. 3*a-d*, show schematic diagrams of aspects of a model updater in accordance with the present disclosure.

Figure 3A:
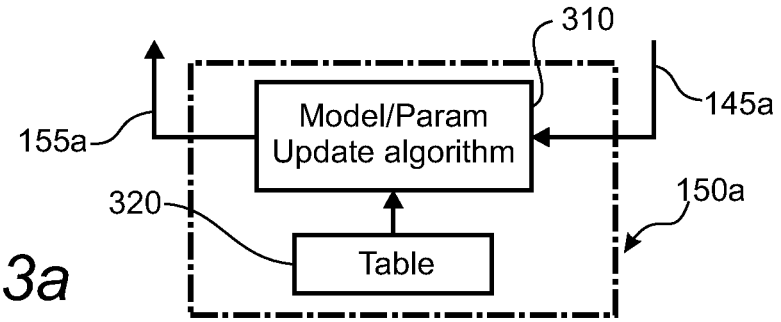
FIGS. 3*a-d*, show schematic diagrams of aspects of a model updater in accordance with the present disclosure.

FIG. 3*a* shows a schematic diagram illustrating aspects of a model updater 150*a* in accordance with the present disclosure. The model updater 150*a* includes an model updating algorithm 310 in accordance with the present disclosure and lookup table 320 coupled thereto. The lookup table 320 may include one or more model parameters, one or more models (e.g., a model bank in accordance with the present disclosure), combinations thereof, or the like. The model updating algorithm 310 may be configured to accept data 145*a* from one or more components in the system, a buffer 140, or the like. In aspects, the release of data 145*a*, or initiation of a model update process may be initiated by a scheduler, determined by an update rate, by a data collection algorithm, combinations thereof, or the like.

In one non-limiting example, the model updating algorithm 310 may include an adaptive model configured to batch process the data 145*a* to predict one or more outcomes (e.g., to predict one or more states, one or more system parameters, etc.). One or more of the outcomes may be compared against an associated parameter, model, etc. included in the lookup table 320. The comparison may be used to determine a substantial match between one or more of the models in the lookup table 320 and the present state of the system. Upon determination of the match, one or more parameters, model coefficients, models, pointers to models, or the like, associated with the matched element(s) of the lookup table 320 may be loaded 155*a* into a buffer 160, or controller 110, 110*a*, 110*b* in accordance with the present disclosure.

In aspects, the model updating algorithm 310 may include an adaptive state based observer, configured to converge to a system model, or a portion thereof, based upon regression of the model output against the data 145*a* or signals generated therefrom (e.g., a displacement estimate derived from the data 145*a*, a loudspeaker impedance derived from the data 145*a*, etc.).

In aspects, the model updating algorithm 310 may include a comparison between the output of the regression function against one or more elements stored in the lookup table 320 (e.g., so as to validate the outcome of the regression). Upon determining that the regression was successful, one or more parameters, model coefficients, inverse model, etc. determined during the regression may be loaded 155*a* into an associated buffer 160, or controller 110, 110*a*, 110*b*.

In aspects, the lookup table 320 may include one or more gain scheduling relationships. The model updater 150*a* may be configured to extract one or more control variables from the data 145*a*, the extracted control variable used to compare against the gain scheduling relationship, the extracted control variable correlating to one or more parameters, which then may be used to update one or more aspects of the controller. Such a configuration may be advantageous for operating and updating a substantially black box controller.

For purposes of discussion, a non-limiting example of a model updating process is shown below. Relating to a physical model (e.g., such as a combination of linear and nonlinear parametric models, or the like) for implementing an linearizing feed-forward loudspeaker controller, an discretized and linearized expression for estimating the voltage u across a loudspeaker voice coil from an input current i through the voice coil may be written as:

$$u_e[n]=(R_e+\sigma_u Bl(0)^2)i[n]+R_e a_1 i[n-1]+(R_e a_2-\sigma_u Bl(0)^2)\ i[n-2]\ \ldots\ -a_1 u[n-1]-a_2 u[n-2] \qquad \text{Equation 4}$$

where $R_e$ is a pseudo DC impedance of the voice coil, $\sigma_u$ is a characteristic gain of a discrete physical voltage function, Bl(0) is a force factor about zero voice coil displacement (may be nonlinear function as well), $a_1$ and $a_2$ are feedback parameters of an associated physical model. This value for u[n] estimated from the current, i can be compared to the measured u[n] to give an error function for use in the model update process.

Such an error function between a model estimated voltage and a measured voltage may be given by:

$$e[n]=u[n]-u_e[n] \qquad \text{Equation 5}$$

Combining Equation 4 with Equation 5 provides the necessary error function for the associated estimation and model update process. The linear parameters [$R_e$ Bl(0) $a_1$ $a_2$] for the physical model used in establishing the estimate between current, i and voltage, u can thus be estimated using a model update algorithm in accordance with the present disclosure (e.g., by minimizing the error function of Equation 5 for a given dataset).

Alternatively a model updating process for a black box model (e.g., such as defined by a Hammerstein-Wiener model, or the like) may include employing a gain scheduling method could be implemented in order to correlate a measurement of voice coil current and voltage to calculate a control variable that may be applied to one or more aspects of the black box model.

In aspects, the small signal, linear aspects of a model may be updated separately from the large signal aspects of the model (e.g., as determined by the model updater, the availability of data, etc.). Such a configuration may be advantageous for better utilizing the available data to generate a robust model fit for an associated transducer at any point in time during use thereof.

In aspects, the model updating algorithm 310 may be configured to accept one or more control signals 115 from the data 145*a*, and to generate one or more state vectors therefrom. Such an estimate may be compared against estimates generated by one or more models from the lookup table 320 for the purpose of model selection, to determine if a model update is needed, to diagnose the status of the associated transducer, etc.

Figure 3B:
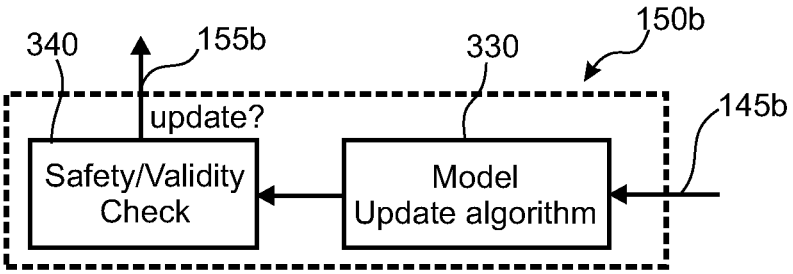

FIG. 3*b* shows a schematic diagram of aspects of a model updater 150*b* in accordance with the present disclosure. The model updater 150*b* may include a model updating algorithm 330 configured to perform regression, model selection, or the like between a measureable state, or accurately estimated state measured by the data 145*b*, and a state estimate as modeled by an adaptive model and the data 145*b* to be updated. In aspects, the model updating algorithm 330 may proceed as follows: choose an initial estimate for the model (e.g., such as by choosing one or more aspects of the presently used model within the controller), perform a regression on the modeled data 145*b* compared with measured states or estimates available from the data 145*b*, update the model based upon the result of the regression, iterate until a predetermined convergence limit is reached. In aspects, the regression may be applied to one or more aspects of the model, a linear model, a large signal model, a function within the model, on a black or grey box model, combinations thereof, or the like.

The model updater 150*b* may include a safety/validity check 340 whereby a validity metric (e.g., such as a goodness of fit metric, a residual metric, an over-fit determining metric, or the like), may be analyzed or produced during the model updating process, and used to determine whether one or more aspects of a model in the associated controller should be updated 155*b*, or not with the newly determined model, parameters, coefficients, etc.

Figure 3C:
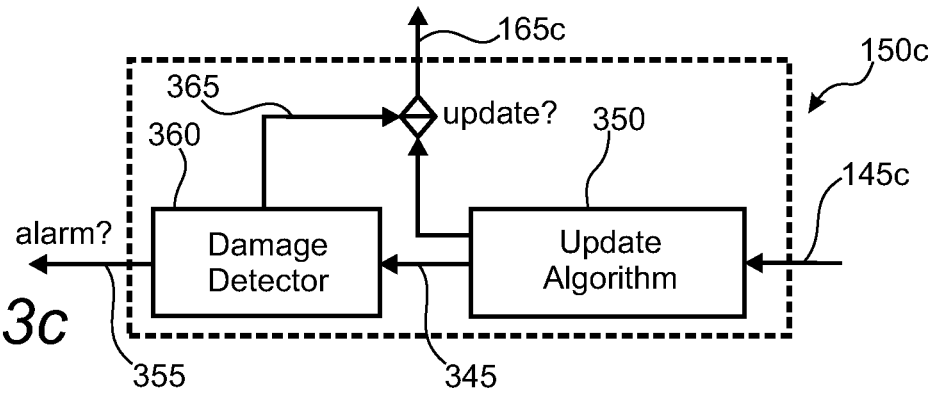

FIG. 3*c* shows a schematic diagram of aspects of a model updater 150*c* in accordance with the present disclosure. The model updater 150*c* may include a model updating algorithm 350 in accordance with the present disclosure configured to perform regression, model selection, or the like between a measureable state, or accurately estimated state measured by the data 145*c*, and a state estimate as modeled by an adaptive model and the data 145*c* to be updated. The model updater 150*c* may include a damage detector 360 configured to analyze the output of the model updating algorithm 350, determine if the value of one or more updated parameters, model coefficients, or the like are within a predetermined range associated with a damaged transducer 130. The damage detector 360 may be configured to accept one or more parameters 345 from the model updating algorithm 350 and to determine whether an associated transducer is damaged or not. If the transducer is damaged, the damage detector 360 may send an alarm 355 to notify one or more processes in the control system, or an associated process on the implemented device. If damage is not detected, the damage detector 360 may provide a validation signal 365 to a decision block, so as to allow one or more updates 165*c* to be generated and sent onto an associated buffer and/or controller.

Figure 3D:
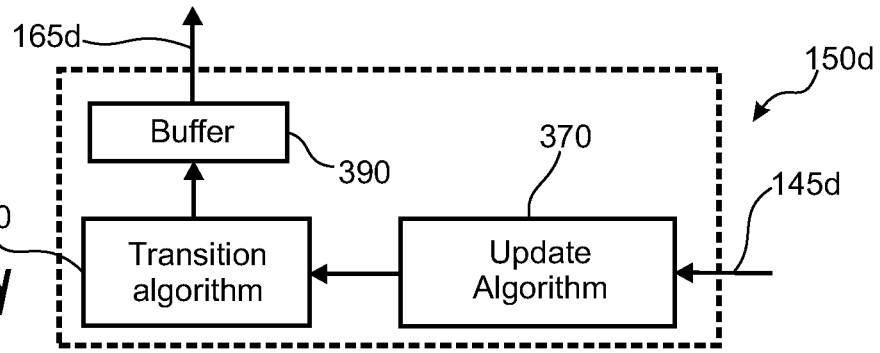

FIG. 3*d* shows a schematic diagram of aspects of a model updater 150*d* in accordance with the present disclosure. The model updater 150*d* may include a model updating algorithm 370 in accordance with the present disclosure configured to perform regression, model selection, or the like between a measureable state, or accurately estimated state measured by the data 145*d*, and a state estimate as modeled by an adaptive model and the data 145*d* to be updated. The model updater 150*d* may include a transition algorithm 380 configured to convert one or more updated parameters, models, coefficients, or the like generated by the model updating algorithm 370 into a form suitable for insertion into a model within an associated controller. In aspects, the transition algorithm 380 may include performing a state space conversion, integrating one or more coefficients into a controller model, building a look up table, etc.

In aspects, the model updater 150*d* may include a buffer 390 configured to store one or more parameters, coefficients, converted elements, pointers, or the like generated by the transition algorithm 380 during use.

The type of model, portion of a model, or the like (e.g., linear dynamic model, nonlinear dynamic model, model coefficients, etc.) under update may be determined by the scheduler, by the information, amplitude, and/or spectral content available in the data 145*b*, by one or more timing events occurring within the system, a diagnostic outcome (e.g., determination of a mismatch between the present controller and the associated transducer dynamics, determination of a system fault, etc.), availability of data associated with a prequalified notification or media clip (e.g., playback of a ring tone, a wakeup notification, a game introduction, a media clip, a movie or TV show introduction, a song, etc.).

In aspects, the model updater 150, 150*a*, 150*b*, 150*c*, 150*d*, a scheduler, or the like may be configured to run a model update upon playback of a media stream (e.g., such as a game introduction, an audio clip in a game, a media clip, a movie or TV show introduction, a song, a commercial, etc.). The playback event may provide the data with sufficient data to complete a model update. In aspects, such audio information may be prequalified, and/or accompanied by a prequalification notification, to signal to one or more components of the system that the appropriate data is being streamed for capture and integration into a model update or optimization process.

In aspects, a system in accordance with the present disclosure may include or be coupled to a prequalification program. The prequalification program may be configured to scan through one or more media files, test the audio stream associated with the file and generate an accompanying notification record. The notification record may be configured to highlight regions of the audio stream that include data within a desirable amplitude range, frequency range, or the like for inclusion into one or more forms of model update process in accordance with the present disclosure. In one non-limiting example, the prequalification program is implemented as a utility, the prequalification program configured to scour the available media files (e.g., files stored locally on the install device, files located in a cloud storage facility, files associated with a streaming service, etc.) to generate one or more notification records.

A notification record may include one or more temporal and data quantifiers associated with a particular media stream to be rendered by a control system in accordance with the present disclosure. In one non-limiting example, the notification record may be configured to store a timespan and data status variable for each usable region of data within a media stream.

In aspects, for playback of an audio stream, a system in accordance with the present disclosure may include prequalification algorithm configured to analyze upcoming audio data within an audio stream under playback to determine suitability of certain data for inclusion into a model update process. In aspects, the prequalification algorithm may look ahead in the audio stream by more than 0.25 sec, 0.5 sec, 1 sec, or the like. In aspects, the prequalification algorithm may generate a notification variable, an associated scheduler, model updater, etc. configured to accept data with a given notification variable for inclusion into a model update process in accordance with the present disclosure.

The model updating algorithm 310, 330, 350, 370 may be configured to update one or more parameters or the like during predetermined tests, during casual operation of the nonlinear control system, at predetermined times during media streaming, as one or more components of the operating system change, as operating conditions change, as one or more key operational aspects (e.g., operating temperature) changes, etc.

The model updating algorithm 310, 330, 350, 370 may include one or more adaptive and/or learning algorithms. In aspects, the adaptive algorithm may include an augmented unscented Kalman filter. In aspects, a least squares optimization algorithm may be implemented to iteratively update the adapted parameters, models, or the like between tests, as operating conditions change, as one or more key operational aspects (e.g., operating temperature) changes, at predetermined timing controlled by a scheduler, etc. Other, non-limiting examples of optimization techniques and/or learning algorithms include non-linear least squares, L2 norm, averaged one-dependence estimators (AODE), Kalman filters, unscented Kalman filters, Markov models, back propagation artificial neural networks, Bayesian networks, basis functions, support vector machines, k-nearest neighbors algorithms, case-based reasoning, decision trees, Gaussian process regression, information fuzzy networks, regression analysis, self-organizing maps, logistic regression, time series models such as auto regression models, moving average models, autoregressive integrated moving average models, classification and regression trees, multivariate adaptive regression splines, and the like.

In aspects, one or more model updating algorithms, validation algorithms, scheduling comparison algorithms, or the like may include a means for optimizing a nonlinear model for a transducer 130 including extracting at least a portion of an impedance spectrum of the transducer 130 during operation (e.g., perhaps during a test, during playback of a media stream, etc.). The impedance data may be used as a target to optimize one or more parameters of the associated nonlinear model. The resulting model parameters may be uploaded to the model after completion, or adjusted directly on the model during the optimization process.

In aspects, insufficient spectral content may be available in a general media stream. In such cases, audio watermarks may be added to the media stream to discreetly increase the spectral content and thus achieve the desired optimization (e.g., white noise, near white noise, noise shaped watermarks, etc. may be added).

Figure 4A:
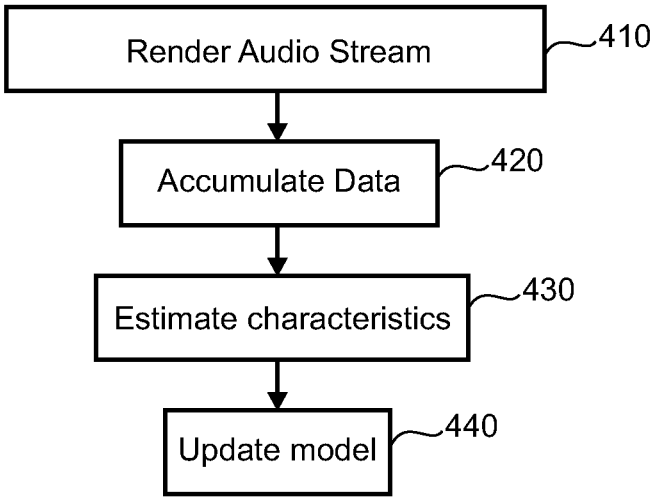
FIGS. 4*a-b* show aspects of methods for collecting data and updating models in accordance with the present disclosure.
Figure 4B:
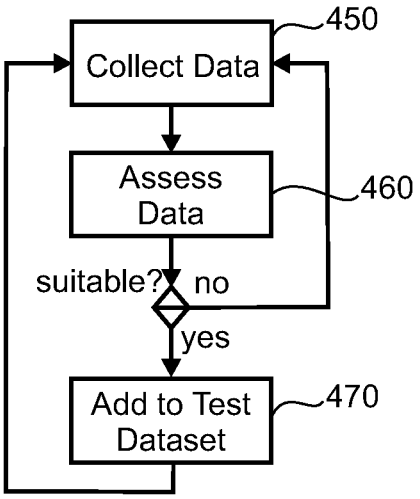

FIGS. 4*a*-*b* show aspects of methods for collecting data and updating models in accordance with the present disclosure.

FIG. 4*a* shows a method for collecting data and updating a model in accordance with the present disclosure. The method includes rendering an audio stream with the transducer 410. In aspects, the audio stream containing an audible notification in accordance with the present disclosure. During rendering, the method includes accumulating data 420 for use in a model update, and estimating one or more system characteristics, model components, or the like from the data 430. The method may also include updating a model 440 in the system. One or more steps of the method may be performed by one or more algorithms, components, or subsystems in accordance with the present disclosure.

FIG. 4*b* shows a method for collecting data and updating a model in accordance with the present disclosure. The method includes collecting data 450 and assessing the data 460 to determine if the data is suitable for performing a model update in accordance with the present disclosure. If the data is suitable, adding the data to a test dataset 470 (e.g., loading the data into a buffer, forwarding the data to a model updater, etc.) for use in a model update, analysis or the like. If the data is not suitable, discard the data and continue collecting data 450. One or more steps of the method may be performed by one or more algorithms, components, or subsystems in accordance with the present disclosure.

Generally speaking, one or more controllers or model updaters in accordance with the present disclosure may include an observer configured to operate under conditions of limited feedback of states from the transducer. In such circumstances, the observer may be augmented with a suitable feed forward state estimator to assist with assessment of states with limited feedback.

In aspects, an observer or non-linear model in accordance with the present disclosure may also be used to enhance robustness of a feedback system (e.g., used in parallel with a feedback controller) by providing additional virtual sensors. One non-limiting example may be the case where a measured state is too far off from the prediction made by the observer or model to be realistic and therefore being rejected as a faulty measurement. In the case of detection of a faulty measurement, the observer or model generated state estimation may be used instead of the direct measurement until valid measurements are produced again.

The nonlinear control system may be configured with real-time impedance based feedback, perhaps over a slower time period, to provide adaptive correction and/or update one or more parameters in the control system, e.g., to compensate for model variations due to aging, thermal changes or the like.

The nonlinear control system may include one or more stochastic models. The stochastic models may be configured to integrate a stochastic control method into the nonlinear control process. The nonlinear control system may be configured so as to shape the noise as measured in the system. Such noise shaping may be advantageous to adjust the noise floor to a higher frequency band for more computationally efficient removal during operation (e.g., via a simple low pass filter).

In aspects, the nonlinear control system may include a gain limiting feature, configured so as to prevent the control signal from deviating too far from the equivalent unregulated signal, so as to ensure stability thereof, limit THD, etc. This gain limiting aspect may be applied differently to different frequencies (e.g., allow more deviation at lower frequencies and less or even zero deviation at higher frequencies).

The state vector may be configured so as to include one or more precisely measureable physical states such as membrane acceleration (a). In such a configuration, the accuracy of the position (x) and velocity (v) related states may be somewhat relaxed while maintaining a high precision match for the acceleration (a). Thus, DC drift of the membrane may be removed from the control output, preventing hard limiting of the membrane during operation.

A nonlinear control system in accordance with the present disclosure may include an analytical and/or black-box model of the amplifier behavior associated with one or more drivers. Such a model may be advantageous for removing artifacts from the control signal that may result in driver instability. One non-limiting example could be to model an AC amplifier as a high-pass filter with its corresponding cut-off frequency and filter slope.

In aspects, the nonlinear control system may include one or more "on-line" optimization algorithms (e.g., a continuously operating model updater). The optimization algorithm may be configured to periodically update one or more model parameters, perhaps during general media streaming. Such a configuration may be advantageous for reducing the effects of model faults over time while the system is in operation. In a laboratory and/or production setting, the optimization algorithm may afford additional state feedback from an associated kinematic sensor (e.g., laser displacement measurements of the cone movement) to more accurately fine tune the associated nonlinear model aspects of the system (e.g., feed-forward model parameters, observer parameters such as covariance matrices, PID parameters and the like). The system may be optimized while measuring as many states as practical. The associated multi-parameter optimization scheme may be configured to optimize to a minimum for the THD within the requested frequency range (e.g., for fundamentals up to 200 Hz, up to 500 Hz, up to 1 kHz, etc.).

In aspects, an optimally configured model (e.g., configured during production), may be augmented with a parametrically adjustable model (e.g., a post-production adaptive control system). During the lifetime of the associated device, the parametrically adjustable model may be adaptively updated around the optimally configured model to maintain ideal operational characteristics. This configuration may be advantageous for improving the optimization results during the lifetime of the device, adaptively mapping the model parameters while recording additional states during production (e.g., by laser or accelerometers) or alternatively by measuring the THD with a microphone and optimizing the system accordingly. Such model updates may benefit from performing the update and recording the audio output 3 with known audio streams. Thus an a priori expectation on the results may be used to discount scenarios where additional background noise, echo, etc. may interfere with a model updating process.

The optimally configured and parametrically adjustable approach may be suitable for removing various aspects of the model that can cause instability or bimodal response with a "black-box" representation thereof (e.g., where the input-to-output characteristics are somewhat blindly mapped using a gain scheduling approach or the like).

In aspects, coupling of an optimally configured manufacturing model plus a parametrically adjustable model may be advantageous for providing a means for matching an entire product line with a single adaptable model, or for matching different types of speakers more easily as the need for a highly precise may be relaxed (e.g., given the ability to tweak the adjustable portion of the model during use). The configuration may be amendable to implementation with an API, laboratory and/or manufacturing tool kit. The system may also be used to characterize optimally configurable (and complex) models for different speaker types (e.g., electro-active polymers, piezo-electric, electrostrictive and other types of electro-acoustic transducers [where a simple model is not a valid description of the system]) while employing a black box model for adaptive correction in the field (e.g., via implementation of one or more automatic control and/or adaptation processes described herein).

In aspects, one or more model parameters associated with a control model, a manufacturing model, a nonlinear function within the model, or the like may be optimized in a lab setting, where full or nearly full state feedback is possible. In this example, a method may include determining a small-signal measurement of equivalent Thiele-Small parameters (linear), making a rough guess to the nonlinear parameter shapes, measuring a large-signal stimuli to determine one or more large signal characteristics, adjust the model parameters until the output states of the model substantially match the measured states. Such a method may be implemented using a trusted region optimization method or the like. The process may also be implemented iteratively with a plurality of measurements or with a range of stimuli. The method may be used to determine a series of substantially fixed coefficients or look up tables to represent one or more nonlinear functions in the associated model. Such fixed components of the model may be combined with one or more model parameters to form an adaptive model that may be updated during use of the associated device.

The method may include setting one or more model parameters (e.g., configuring a covariance matrix) of the controllers target dynamics and/or inverting dynamics aspects by any known technique. In aspects, the setting may be achieved by a brute-force approach including testing all possible regulator parameters within reasonable intervals to find the settings for minimum THD. The minimum THD can then be measured on the real system and simulated by the model and used to correct for changes experienced by the device in the field. This approach may also be done iteratively while measuring the actual THD in each measurement iteration.

The method may include configuring one or more adjustable parameters. Such configuring may be achieved by, for example, a "brute-force" approach or the like, whereby all possible values within reasonable limits are tested while measuring the THD of the speaker and searching for a minimum.

Such a method may include measuring the impedance in accordance with the present disclosure. If real-time impedance measurements demonstrate a parameter mismatch severely (e.g., via severe changes in temperature or ageing), the system may automatically use the new impedance curve to map the nonlinear model to the new system in real-time. Thus a technique for continuously and dynamically adapting model parameters may be provided during system operation.

Such an approach may be performed in real-time. When a reliable impedance curve is obtained during measurement, a model or parameter update process may be initiated. As temperature changes or aging effects may occur relatively slowly compared with the system dynamics, such an adaptation approach may run occasionally, whenever the processor is "free" and does not suffer from real-time requirements on a sample rate basis.

In aspects, the model may include an enclosure model to compensate for a closed, vented, or leaky configuration so as to match the implementation in question.

In accordance with the present disclosure, the controller may be divided into "Target Dynamics" (corresponding to the target behavior, e.g., a linear behavior) and "Inverse Dynamics" (which is basically aiming to cancel out all dynamics of the un-controlled system, including non-linearities) aspects. In this case, the target dynamics portion may include one or more nonlinear effects, such as psychoacoustic non-linearities, a compressor, or any other "target" behavior. Thus the controller may merge the nonlinear compensation aspects with the enhanced audio performance aspects.

A nonlinear control system in accordance with the present disclosure may be configured to work over primarily a low frequency spectrum (e.g., less than 1000 Hz, less than 500 Hz, less than 200 Hz, less than 80 Hz, less than 60 Hz, etc.). In one non-limiting application, the nonlinear control system may be configured to operate on a modified input signal. In this case, the input signal may be divided within the woofer band with another crossover (e.g., at 80 Hz, 200 Hz, etc.). The modified input signal delivered to the nonlinear control system may be focused only on the band below the crossover. Additional aspects are discussed throughout the disclosure.

A nonlinear control system in accordance with the present disclosure may be embedded in an application specific integrated circuit (ASIC) or be provided as a hardware descriptive language block (e.g., VHDL, Verilog, etc.) for integration into a system on chip (SoC), an application specific integrated circuit (ASIC), a field programmable gate array (FPGA), or a digital signal processor (DSP) integrated circuit.

Alternatively, additionally, or in combination, one or more aspects of the nonlinear control system may be soft-coded into a processor, flash, EEPROM, memory location, or the like. Such a configuration may be used to implement the nonlinear control system at least partially in software, as a routine on a DSP, a processor, and ASIC, etc.

It will be appreciated that additional advantages and modifications will readily occur to those skilled in the art. Therefore, the disclosures presented herein and broader aspects thereof are not limited to the specific details and representative embodiments shown and described herein. Accordingly, many modifications, equivalents, and improvements may be included without departing from the spirit or scope of the general inventive concept as defined by the appended claims and their equivalents.

What is claimed is:

1. A nonlinear control system for rendering a media stream through a transducer, the nonlinear control system comprising:

a controller comprising a model configured to accept an input signal relating to the media stream and to output a control signal to drive an amplifier and/or the transducer for rendering the media stream thereupon, the model configured to compensate for one or more acoustic characteristics of the transducer, the amplifier, and/or an environment;

one or more sensors coupled with the transducer, the amplifier, and/or the environment and configured to generate a feedback signal therefrom; and a model updater coupled with the controller, configured to accept a dataset derived from the feedback signal, the input signal, the control signal, and/or a signal generated therefrom, and to update one or more aspects of the model based upon an analysis of the dataset; wherein the model updater comprises or interfaces with a bank of models, each model in the bank configured to generate an estimate of a state from the dataset, the model updater configured to compare the state against one or more aspects of the dataset as part of the analysis.

2. The nonlinear control system in accordance with claim 1, wherein the one or more of sensors are configured to measure or generate a signal related to a current, voltage, an impedance, a conductance, a substantially DC impedance value, a resonant property, a temperature, a voice coil current, a voice coil temperature, a membrane or coil displacement, a velocity, an acceleration, an air flow, a chamber back pressure, a transducer vent airflow, a sound pressure level, a kinetic measurement, a magnetic field measurement, a pressure, a humidity, or a combination thereof.

3. The nonlinear control system in accordance with claim 1, wherein the controller is configured to operate at a rendering rate and the model updater is configured to periodically update the model at an updating rate, the updating rate substantially slower than the rendering rate.

4. The nonlinear control system in accordance with claim 3, wherein the updating rate is less than 1 update per hour.

5. The nonlinear control system in accordance with claim 3, further comprising a scheduler configured to determine the updating rate through analysis of the dataset.

6. The nonlinear control system in accordance with claim 5, wherein the scheduler is configured to analyze one or more metrics associated with the dataset to determine a subset thereof that is suitable for performing an update therefrom.

7. The nonlinear control system in accordance with claim 6, wherein metrics are associated with amplitude, bandwidth, relationships between, or combinations thereof in the input signal, control signal, rendered media stream, and/or feedback signal.

8. The nonlinear control system in accordance with claim 1, further comprising a buffer coupled with the model updater and configured to store at least a portion of the dataset.

9. The nonlinear control system in accordance with claim 1, wherein the model updater comprises a robust regression algorithm to perform at least a portion of the analysis.

10. The nonlinear control system in accordance with claim 1, wherein the model updating function comprises a selection algorithm, the selection algorithm configured to select a model from a model bank or a model related to a model in the model bank based upon the comparison.

11. The nonlinear control system in accordance with claim 1, wherein the system is configured to accept a notification, the notification integrated into the media stream, at least a portion of the dataset derived from the media stream rendered during the notification.

12. The nonlinear control system in accordance with claim 11, wherein the notification comprises a media clip relating to a ring tone, a wakeup notification, a game sound clip, a media introduction, a video clip, movie or TV show clip, a song clip, an event, a power-up event, a user notification, a sleep recovery event, a touch audio response, or a combination thereof associated with the rendered media stream.

13. The nonlinear control system in accordance with claim 1, wherein the model performs a change detection algorithm configured to analyze the dataset to determine if a substantial difference exists between the model in the controller and one or more acoustic characteristics of the transducer.

14. The nonlinear control system in accordance with claim 13, wherein the model in the controller comprises a linear dynamic model and a nonlinear model.

15. The nonlinear control system in accordance with claim 14, wherein the model updater is configured to update a portion of the linear dynamic model or the nonlinear model based upon the analysis of the dataset.

16. The nonlinear control system in accordance with claim 13, wherein the change detection algorithm is used to determine at least a portion of an updating rate.

17. The nonlinear control system in accordance with claim 13, wherein the transducer includes a deficient acoustic characteristic of sufficient severity so as to corrupt rendering of the input signal without compensation, the model in the controller configured to compensate for the deficient acoustic characteristic so as to effectively render the media stream on the transducer without substantial corruption.

18. The nonlinear control system in accordance with claim 17, wherein the transducer is a speaker, and the deficient acoustic characteristic is a nonlinearity and/or instability of a force factor, stiffness, and/or mechanical resistance associated with the speaker.

19. The nonlinear control system in accordance with claim 17, wherein uncompensated deficient acoustic characteristic contributes to more than 10% of an acoustic output from the transducer, the model in the controller configured to reduce this contribution by less than 10%.

20. The nonlinear control system in accordance with claim 17, wherein the model updater is configured to update the model in the controller whenever the compensated deficient acoustic characteristic contributes more than 5% above a residual threshold thereof.

21. The nonlinear control system in accordance with claim 17, wherein the transducer is designed to have a relatively high efficiency while sacrificing sound quality, THD, and/or IMD in an uncompensated operating state, the controller configured to substantially improve the sound quality, THD and/or IMD while maintaining the relatively high efficiency thereof in a compensated operating state.

22. The nonlinear control system in accordance with claim 1, wherein the nonlinear control system is included in a mobile consumer electronic device.

23. The nonlinear control system in accordance with claim 22, wherein the consumer electronics device is a smartphone, a tablet computer, a wearable computing device, or a soundbar.

24. The nonlinear control system in accordance with claim 1, wherein the amplifier, the scheduler, and/or the model updater comprises a means for estimating a characteristic temperature of the transducer from one or more of the feedback signals, and delivering the estimate to one or more of the controller and/or the model updater, the controller and/or the model updater configured to incorporate the temperature estimate into the compensation and/or analysis algorithms, respectively.

25. Use of a system in accordance with claim 1, to improve the efficiency of a transducer family without substantially compromising sound quality.

26. Use of a system in accordance with claim 1, to reduce THD and/or IMD in a rendered media stream.

27. A method for updating a model for use in rendering an audio stream on a transducer comprising:

collecting data associated with the audio stream over one or more time periods to form a dataset;

analyzing the dataset to determine if content has amplitude and spectral content above a predetermined threshold sufficient to perform the update;

generating an updated model or portion thereof using at least a portion of the dataset;

updating the model with the updated model or portion thereof; and comparing output of a plurality of predetermined models against at least a portion of the dataset, and selecting a model associated with one of the plurality of predetermined models to be the updated model, wherein the comparison is based upon analysis of a metric comparing closeness of fit between the predetermined models and the portion of the dataset.

28. The method in accordance with claim 27, wherein metric is a robust residual, a cumulative sum of error, a maximum likelihood assessment, a likelihood ratio test, a square residual threshold test, an amplitude comparison between input and output across frequency bands of interest, or a combination thereof between one or more estimates generated by predetermined models and the dataset.

29. The method in accordance with any one of claim 27, wherein at least one of the one or more time periods is longer than 0.1 second.

* * * * *